US012618295B1

(12) United States Patent
Turner

(10) Patent No.: US 12,618,295 B1
(45) Date of Patent: May 5, 2026

(54) DRILLING HEAD ASSEMBLY WITH SPRING LOADED LATCHING SYSTEM

(71) Applicant: Joshua Grant Turner, West Valley, UT (US)

(72) Inventor: Joshua Grant Turner, West Valley, UT (US)

( * ) Notice: Subject to any disclaimer, the term of this patent is extended or adjusted under 35 U.S.C. 154(b) by 0 days.

(21) Appl. No.: 19/045,502

(22) Filed: Feb. 4, 2025

(51) Int. Cl.
*E21B 17/046* (2006.01)
*E21B 34/06* (2006.01)

(52) U.S. Cl.
CPC ..... *E21B 17/046* (2013.01); *E21B 34/06* (2013.01); *E21B 2200/04* (2020.05)

(58) Field of Classification Search
CPC ..... E21B 17/046; E21B 34/06; E21B 2200/04
See application file for complete search history.

(56) References Cited

FOREIGN PATENT DOCUMENTS

| | | | | |
|---|---|---|---|---|
| CA | 2936117 C | * | 1/2021 | ..... E21B 23/02 |
| CN | 105804670 A | * | 7/2016 | ..... E21B 17/046 |
| WO | WO-2025095985 A1 | * | 5/2025 | ..... E21B 17/06 |

OTHER PUBLICATIONS

Canadian Patent Publication (Year: 2021).*
Chinese Patent Publication (Year: 2016).*
International Patent Publication (Year: 2023).*

* cited by examiner

*Primary Examiner* — James G Sayre
(74) *Attorney, Agent, or Firm* — TechLaw Ventures, PLLC; Terrence J. Edwards

(57) ABSTRACT

An assembly for a drilling operation. The assembly includes a retractor case comprising a sidewall and retractor pin slot disposed within the sidewall, wherein the sidewall defines a retractor interior space. The assembly includes a body comprising a body sidewall and body pin slot disposed within the body sidewall, wherein the body sidewall defines a body interior space, and wherein the body interior space is configured to receive the retractor case. The assembly includes a first latch ear coupled to the retractor case, a second latch ear coupled to the retractor case, and a compression spring disposed in between the first latch ear and the second latch ear. The latch ear assembly is such that a mechanical equilibrium for the compression spring causes at least a portion of the first latch ear and at least a portion of the second latch ear to extend outward relative to the body sidewall.

20 Claims, 25 Drawing Sheets

Expansion Block Latch Assembly In Unlatched Configuration

Expansion Block Latch Assembly In Latched Configuration

Unlatched Configuration, Expansion Block Located Toward Uphole End Of Pin Slot

Latched Configuration, Expansion Block Located Toward Downhole End Of Pin Slot

Closed Configuration; Valve Ball Disposed Within Valve Bushing

Open Configuration; Valve Ball Floating Uphole Relative To Valve Bushing

Viscosity Adjustment Screw Fully Disposed Within Tube Cap Piston;
Maximum Fluid Viscosity Is Increased Viscosity Adjustment Screw Only Partially Disposed Within Tube Cap Piston;
Maximum Fluid Viscosity Is Decreased Spring Loaded Latch Assembly In Retracted Position Spring Loaded Latch Assembly In Extended Position Latch Ears In Retracted Orientation Latch Ears In Extended Orientation

DRILLING HEAD ASSEMBLY WITH SPRING LOADED LATCHING SYSTEM

TECHNICAL FIELD

The disclosure relates generally to assemblies for use in a drilling operation.

BACKGROUND

The disclosure relates generally to a head assembly for a drilling operation. The head assembly is a portion of the equipment needed to execute a drilling operation, and works in concert with a drill bit below, a core barrel above the drill bit, a head assembly above the core barrel, and an overshot that is introduced into the hole created by the drill bit. The overshot latches onto the head assembly, which in turn couples with the core barrel to lift the drilled earth from the formation out of the hole.

Conventional, known wireline drilling operations include head assemblies that can perform their intended tasks, albeit with some inefficiencies and losses that have been considered unavoidable and accepted. The head assembly and some of its subcomponents experience a harsh environment in the newly drilled hole and are subject to wear due to friction, fracture, and deformation due to stress. Drilling operations with the conventional head assemblies also consume fluid, including water and/or drilling mud. Consuming less of these fluids translates directly to a more efficient drill, and therefore a more profitable endeavor. Thus, there are problems with conventional head assemblies that remain in need of a solution.

The features and advantages of the disclosure will be set forth in the description, which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like, which has been included in the specification is not to be taken as an admission that any or all of these matters form part of the prior art base or were common general knowledge in the field relevant to the disclosure as it existed before the priority date of each claim of this disclosure.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

Figure 1:
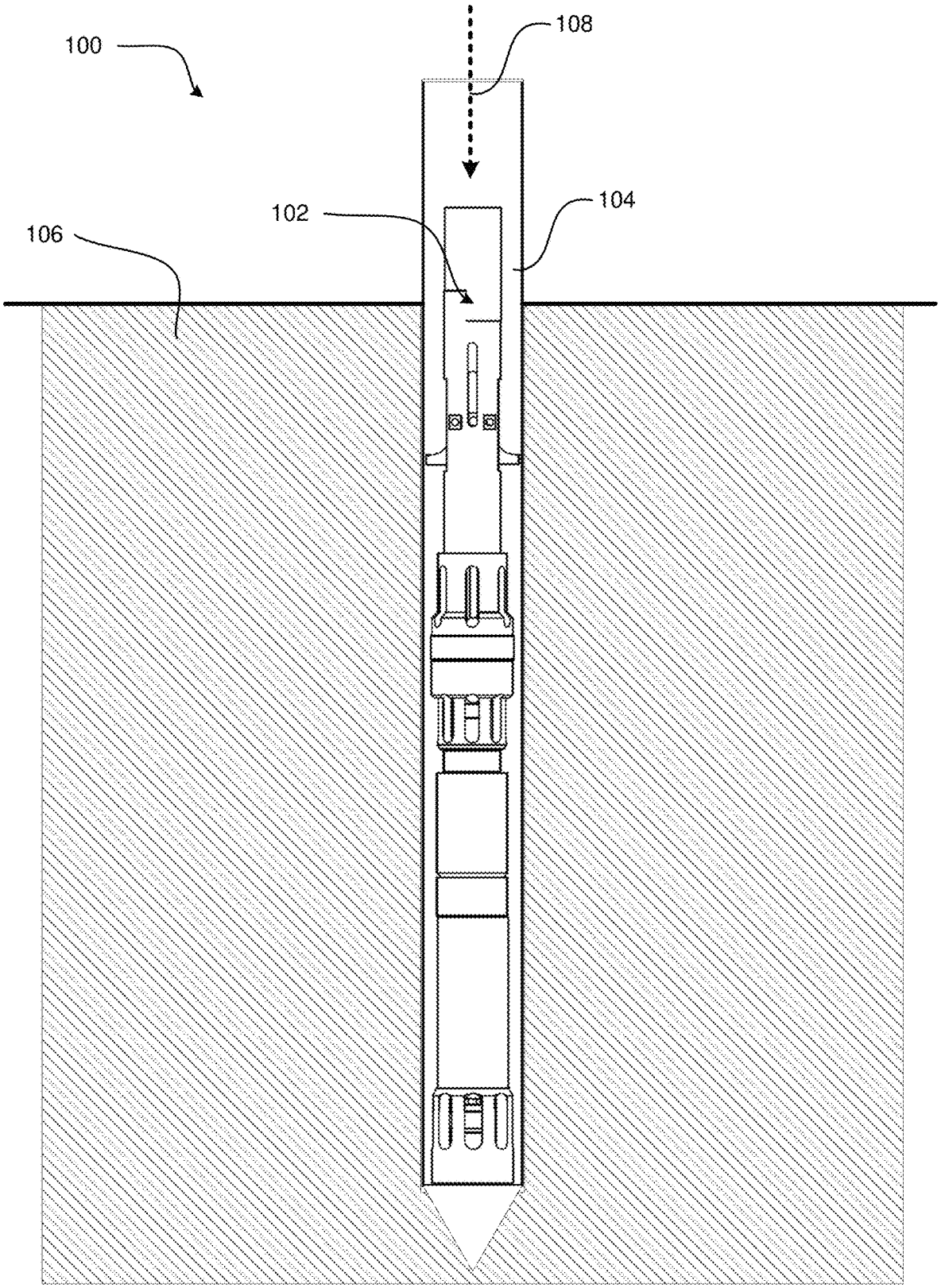
FIG. 1 is a schematic cross-sectional illustration of a system for performing a drilling operation.

Disclosed herein are systems, methods, and devices for performing drilling operations. Specifically disclosed herein is an assembly for performing a drilling operation that includes at least a latch assembly portion, a check valve assembly portion, and a tube cap assembly portion. The drilling assembly described herein may be disposed downhole at the end of a drill string used in oil, gas, and geothermal drilling operations. The drilling assembly described herein may be referred to as a bottom hole assembly (BHA) for a drilling operation.

The drilling assembly described herein includes at least a latch assembly portion, check valve assembly portion, and tube cap assembly portion. The drilling assembly may be configured with either of an expansion block latch assembly, or a spring load latch assembly as described herein. Either of the expansion block latch assembly or the spring loaded latch assembly may be combined with any of the check valve assembly components or tube cap assembly components as described herein. The latch assembly configuration may be selected based on the desired use-case and implementation.

The latch assembly portion of the drilling assembly described herein is configured to secure the drilling assembly to a separate tube that surrounds the drilling assembly during a drilling operation. One latch assembly described herein includes an expansion block for adjusting a position of the latch ears. This expansion block latch assembly includes a retractor case comprising a retractor sidewall and a retractor pin slot disposed within the retractor sidewall, wherein the retractor sidewall defines a retractor interior space. The latch assembly includes a body comprising a body sidewall and a body pin slot disposed within the body sidewall, wherein the body sidewall defines a body interior space, and wherein the body interior space is configured to receive the retractor case. The latch assembly includes a latch ear coupled to the body, wherein at least a portion of the latch ear extends outward relative to the body sidewall. The latch assembly includes an expansion block at least partially disposed within the retractor interior space. The latch assembly is such that a position of the expansion block along a longitudinal axis of the drill assembly determines whether the latch ear is in an extended position or a retracted position relative to the body sidewall.

Another latch assembly described herein includes a spring for adjusting a position of the latch ears. This spring loaded latch assembly includes a retractor case comprising a retractor sidewall and a retractor pin slot disposed within the retractor sidewall, wherein the retractor sidewall defines a retractor interior space. The latch assembly includes a body comprising a body sidewall and a body pin slot disposed within the body sidewall, wherein the body sidewall defines a body interior space, and wherein the body interior space is configured to receive the retractor case. The latch assembly includes a first latch ear coupled to the body, a second latch ear coupled to the body, and a compression spring disposed within the body interior space, wherein the compression spring is disposed in between the first latch ear and the second latch ear. The latch assembly is such that a mechanical equilibrium for the compression spring causes at least a portion of the first latch ear and at least a portion of the second latch ear to extend outward relative to the body sidewall.

The check valve assembly portion of the drill assembly described herein is configured to adjust the flow of fluid through the drill assembly. The drill assembly includes a body comprising a sidewall, wherein the sidewall defines a hollow interior comprising a fluid chamber, and wherein the hollow interior is aligned with a longitudinal axis of the drill assembly. The drill assembly includes a fluid retention piston disposed within the fluid chamber, wherein the fluid retention piston comprises a fluid port enabling a fluid to pass through the fluid retention piston. The drill assembly includes the check valve assembly disposed within the fluid retention piston, wherein the check valve assembly comprises: a valve bushing comprising a sidewall that defines a bushing interior space; a valve ball; and a valve spring. The check valve assembly is in a closed configuration when the valve ball is at least partially disposed within the bushing interior space and prevents fluid from flowing through the bushing interior space.

The tube cap assembly portion of the drill assembly described herein is configured to adjust the maximum viscosity of fluid permitted to flow through ports of the drill assembly. The tube cap assembly includes a tube cap piston comprising a threaded recess. The tube cap assembly includes a viscosity adjustment screw coupled to the tube cap piston, wherein a threaded portion of the viscosity adjustment screw is screwed into the threaded recess of the tube cap piston. The tube cap assembly includes a tube cap comprising a tube cap sidewall, wherein the tube cap further comprises a tube cap port disposed within the tube cap sidewall. The tube cap assembly is such that the tube cap piston and the viscosity adjustment screw are disposed within a hollow interior space defined by the tube cap sidewall. The tube cap assembly is such that a fluid passageway is formed in between the tube cap port and an exterior surface of the tube cap piston. The tube cap assembly is such that the threaded portion of the viscosity adjustment screw is threaded into or out of the threaded recess of the tube cap piston to adjust a size of the fluid passageway.

In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems, and devices that form this disclosure of a novel drill assembly are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and gram[1] matical equivalents thereof exclude any element, step, or ingredient not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

Referring now to the figures, FIG. 1 is a schematic cross-sectional illustration of a system 100 for performing a drilling operation. The system 100 is utilized to drill into a substrate 106 such as dirt, rocks, and other materials, and is further used when extracting a substance such as oil, gas, or minerals from the substrate 106. The system 100 includes an overshot 104 and a head assembly 102 disposed within the overshot 104. An external force 108 may be applied to the head assembly 102 when executing the drilling operation.

Figure 2A:
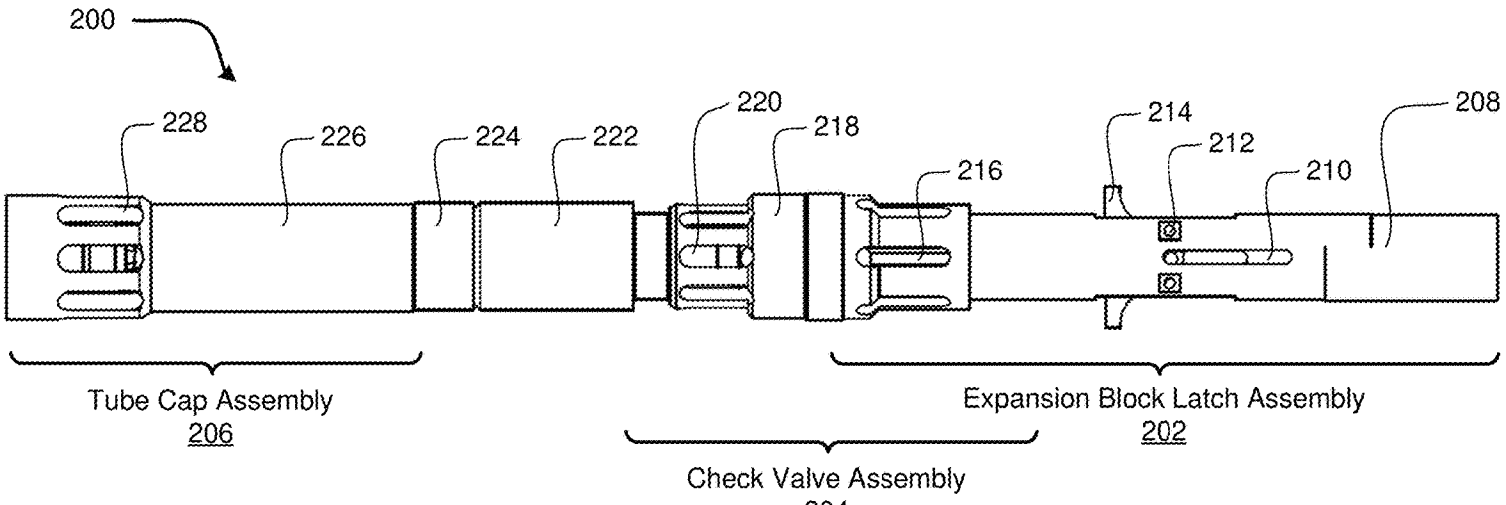
FIG. 2A is a straight-on side view of an assembly for performing a drilling operation.
Figure 2B:
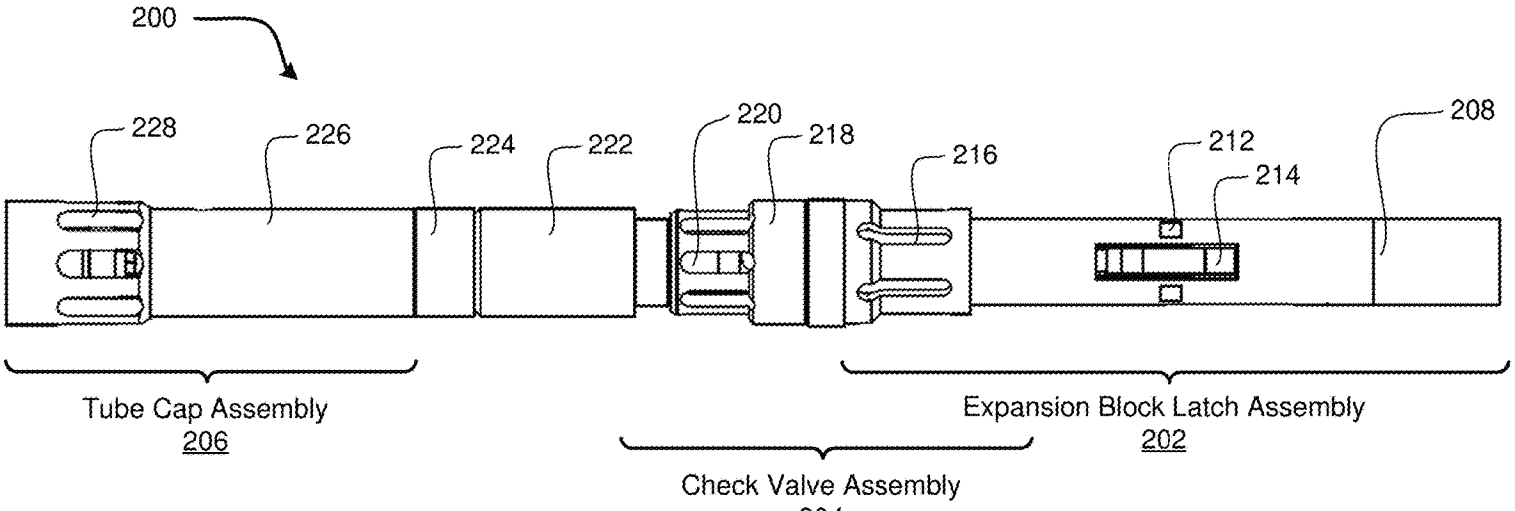
FIG. 2B is a straight-on side view of an assembly for performing a drilling operation, wherein the drill assembly is rotated ninety degrees relative to the view illustrated in FIG. 2A.

FIGS. 2A and 2B each illustrate a straight-on side view of a head assembly 200 for performing a drilling operation. The head assembly 200 is configured to be disposed within an overshot 104, like the head assembly 102 illustrated in FIG. 1. In FIG. 2B, the head assembly 200 is rotated 90 degrees about its longitudinal axis when compared with the illustration in FIG. 2A. The head assembly 200 includes at least an expansion block latch assembly 202, a check valve assembly 204, and a tube cap assembly 206. The head assembly 200 may include additional components or assemblies, and some components of the head assembly 200 may be utilized by two or more of the expansion block latch assembly 202, the check valve assembly 204, or the tube cap assembly 206. As described herein, the head assembly 200 includes an "uphole end" that is located nearest the surface of a substrate during a drilling operation, and further includes a "downhole end" that is located deeper in the substrate relative to the uphole end. The expansion block latch assembly 202 is located at the uphole end of the head assembly 200, and the tube cap assembly 206 is located at the downhole end of the head assembly 200.

The head assembly 200 includes an upper body 208 that comprises a cylindrical geometry. The upper body 208 includes a body pin slot 210, which is an opening disposed in a sidewall of the cylindrical upper body 208. The upper body 208 further includes a body pivot hole 212, which is an opening disposed in a sidewall of the cylindrical upper body 208. The upper body 208 encases components of the expansion block latch assembly 202 and is configured to interface with a retractor case (not illustrated in FIGS. 2A-2B).

The head assembly 200 includes at least one latch ear 214 as a component of the expansion block latch assembly 202. As shown in FIG. 2A, the head assembly may include two latch ears 214 that are diametrically opposed to one another relative to the cylindrical geometry of the upper body 208. At least a portion of the latch ear 214 is disposed within a hollow inner space defined by the sidewall of the upper body 208. The portion of the latch ear 214 that is visible in FIG. 2A is configured to interface with the inner wall of a concentric tube surrounding the head assembly 200.

The latch ears 214 are pivotably connected to the upper body 208 and positioned within a latch ear opening (not shown) that is disposed through the sidewall of the upper body 208. The latch ears 214 are selectively pivoted to expand or retract away from or toward cylindrical geometry of the upper body 208. Expanding and retracting the latch ears 214 prevents or at least mitigates wear on the latch ears 214, and further facilitates releasing the latch ears 214 such that the head assembly 200 may be pulled up from the drilling hole. Conventional designs of head assemblies comprising a latching mechanism do not have the ability to retract the latching mechanism. This results in the traditional head assemblies experiencing excessive wear when the latching mechanisms drag along an interior surface of the tube when the head assembly is removed from the tube.

The check valve assembly 204 is formed where a downhole end of the upper body 208 interfaces with an uphole end of a lower body 218. As discussed further herein, the check valve assembly 204 includes components for creating a valve that reacts to an external force to permit or block the flow of fluid. The upper body 208 includes an upper body fluid port 216 that permits fluid to flow into and out of an interior space defined by a sidewall of the upper body 208. The lower body 218 includes a lower body fluid port 220 that permits fluid to flow into and out of an interior space defined by a sidewall of the lower body 218.

The fluid passageways defined through the head assembly 200 created by ports within the upper body 208 and lower body 218 cause fluid to flow through the head assembly 200 with laminar flow, rather than turbulent flow. In at least one implementation, the fluid flow is dominated by laminar flow, with some limited turbulence. With the laminar or laminar-dominated flow, the head assembly 200 can be run in-hole through the fluid in a more efficient manner than other known conventional head assemblies that do not achieve laminar flow. The turbulence causes wear and energy losses.

The head assembly 200 further includes a spindle 222, a shock absorber body 224, and a tube cap 226. The spindle 222 includes a shaft for receiving bearings to be attached to the head assembly 200 as a replaceable wear item. Additionally, the spindle 222 serves as a shock absorber when the latch assembly portion 202 is stopped at a landing ring located within a core barrel. The stopping forces are transferred to the head assembly 200 and then absorbed by a shock absorption spring disposed around the spindle 222.

The tube cap includes a tube cap port 228 that permits fluid to flow into and out of an interior space defined by a sidewall of the tube cap 226. The spindle 222 is a shock-absorbing component that prevents or mitigates damage to the head assembly 200 caused when the components of the drilling operation contact one another, such as when the head assembly 200 is lowered into the well and reaches the core barrel, or when an overshot is lowered to the head assembly 200 and strikes the retractor case (see, e.g., retractor case 302 first discussed in connection with FIGS. 3A and 3B).

The head assembly 200 is designed such that the amount of fluid passing through the head assembly 200 can be controlled and adjusted during operation. In operation the procedure may be as follows. The head assembly 200 is lowered through the tube, and as it does so, at some point the head assembly 200 reaches the water table and begins to pass through the water which may also include mud, sand, debris, sediment, hydrocarbons, and other objects. The head assembly 200 eventually reaches the core barrel (not shown) below and interfaces with it. The core barrel and head assembly 200 connect securely together. The drilling operation can continue with the bit being below the core barrel. As the bit is operated, a fluid is pumped down to the head assembly 200 and through the head assembly 200 to lubricate and cool the drill bit. The fluid may comprise water, mud, or some combination thereof. By adjusting the flow of fluid through the head assembly 200, an operator can retain more of the fluid that is below the head assembly 200, and thereby reduce the amount of new fluid that must be pumped down into the well from above.

Figure 3A:
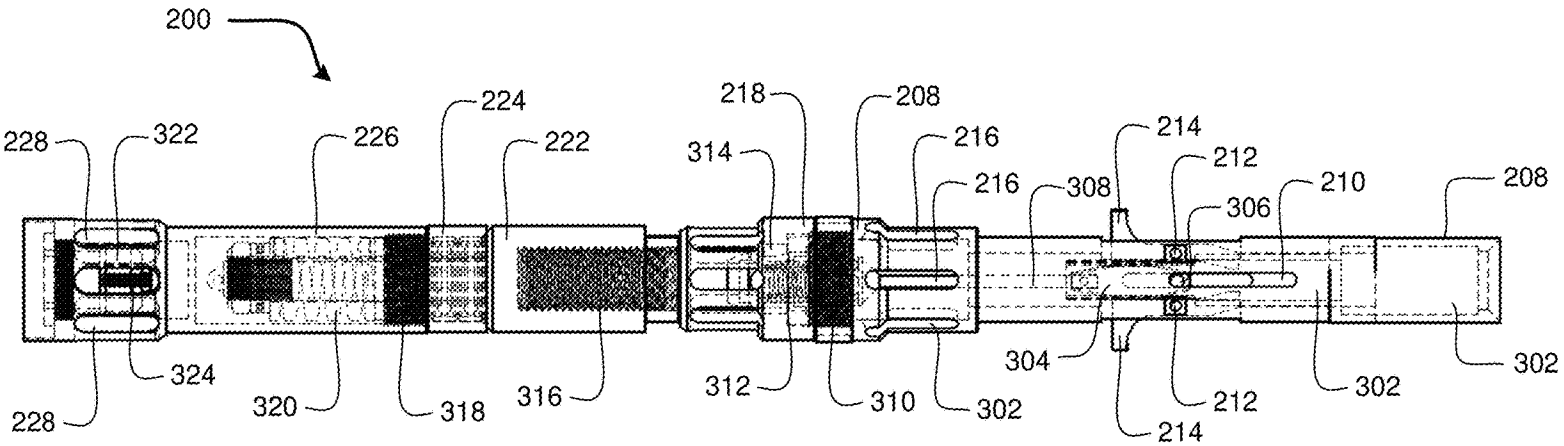
FIG. 3A is a wireframe straight-on side view of an assembly for performing a drilling operation.
Figure 3B:
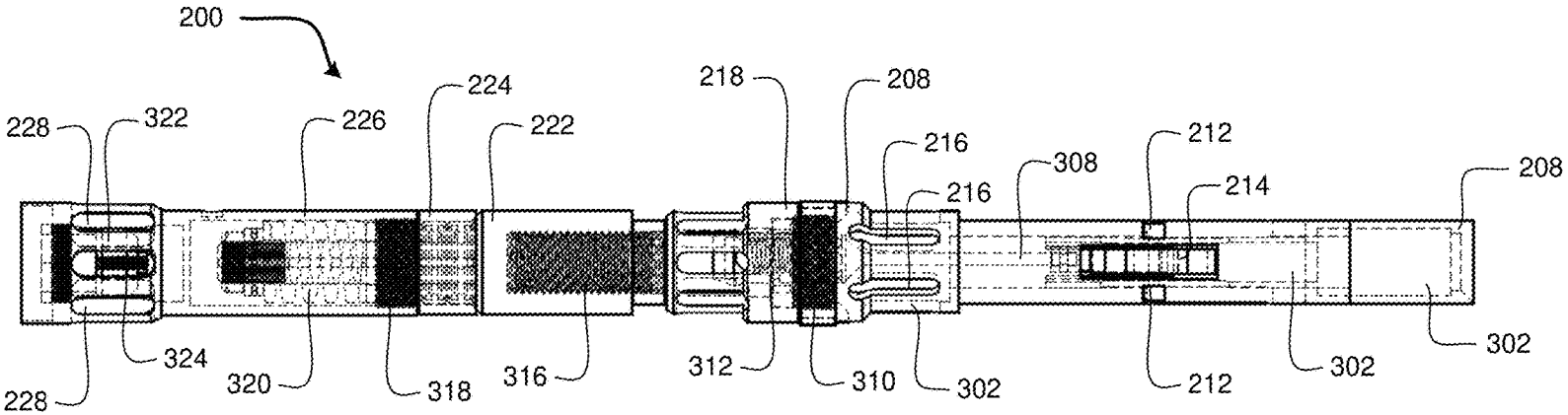
FIG. 3B is a wireframe straight-on side view of an assembly for performing a drilling operation, wherein the drill assembly is rotated ninety degrees relative to the view illustrated in FIG. 3A.

FIGS. 3A and 3B illustrate wireframe straight-on side views of the head assembly 200. Similar to the views illustrated in FIGS. 2A-2B, the head assembly 200 depicted in FIG. 3B is rotated 90 degrees about its longitudinal axis when compared with the illustration in FIG. 3A. The wireframe views in FIGS. 3A-3B illustrate the external components of the head assembly 200 in solid lines, and additionally illustrates internal components of the head assembly 200 with dotted lines.

The head assembly 200 includes a retractor case 302 disposed within the upper body. 208. The upper body 208 comprises a sidewall that defines a hollow interior space and a substantially cylindrical geometry. Similarly, the retractor case 302 includes a sidewall that defines a hollow interior space and a substantially cylindrical geometry. The diameters of the upper body 208 and the retractor case 302 are optimized such that the retractor case 302 can slide into the upper body 208. In some implementations, the retractor case 302 interfaces with an overshot (not pictured) that is lowered down into a drilling hole and then attaches to the retractor case 302. The retractor case 302 may include grooves, recesses, or other features that permit the overshot to be urged downward without actuating a tool or other moving part to secure the overshot to the retractor case 302. The retractor case 302 includes a retractor pin slot (not shown) that matches with the body pin slot 210 of the upper body 208. Thus, a single pin may be pushed through the overlapping retractor pin slot and body pin slot 210.

The expansion block latch assembly 202 of the head assembly 200 includes an expansion block 304 disposed within an interior space defined by the sidewall of the upper body 208. The expansion block 304 is configured to interface with the latch ears 214 to cause the latch ears 214 to extend outward in a "latched" position or retract inward in an "unlatched" position. The expansion block 304 includes an expansion block pinhole 306 disposed through the expansion block 304. The expansion block pinhole 306 is configured to receive a pin to pull the expansion block 304 upward toward the uphole end of the head assembly 200 or push the expansion block 304 down toward the downhole end of the head assembly 200. The pin disposed through the expansion block pinhole 306 is also disposed through the body pin slot 210 and the retractor pin slot (not shown). Thus, the expansion block 304 can only slide along the longitudinal axis of the head assembly 200 from a downhole end of the body pin slot 210 (as shown in FIGS. 3A-3B) and up to an uphole end of the body pin slot 210. When the expansion block 304 is located at the downhole end of the body pin slot 210 (as shown in FIGS. 3A-3B), then the expansion block 304 pressed on the latch ears 214 and causes the latch ears 214 to extend outward into the latched position. When the expansion block 304 is pulled up toward the uphole end of the body pin slot 210, the latch ears 214 are allowed to rotate about the body pivot hole 212 and fall into the unlatched position.

The expansion block 304 is attached to a piston shaft 308, which is attached to a piston cage (not shown). The piston cage (not shown) includes holes that permit fluid to flow into and out of the piston cage. When pressurized fluid flows through the piston cage, the pressurized flow is able to actuate the check valve assembly 204. Some, but not all, components of the check valve assembly 204 are visible in FIGS. 3A-3B. Specifically, FIGS. 3A-3B illustrate portions of the valve spring 312 and retention piston 314. These components will be further illustrated and discussed in subsequent figures. FIGS. 3A-3B further illustrate threading 310 for attaching the lower body 218 to the upper body 208. The threading enables the downhole end of the upper body 208 to be attached to the uphole end of the lower body 218.

The head assembly 200 further includes threading 316 within the spindle 222. The threading 316 includes corresponding threading on the spindle 222 and the lower body 218. The threading 316 is utilized to securely attach the spindle 222 to the lower body 218. The head assembly 200 further includes threading 318 on the shock absorber body 224 and tube cap 226. This threading 318 is utilized to attach the tube cap 226 to the shock absorber body 224.

The tube cap assembly 206 of the head assembly 200 includes a shock absorber 320, which may include a compression spring configured to absorb a force along a longitudinal axis of the head assembly 200. The tube cap assembly 206 further includes a tube cap piston 322 (only partially visible in FIGS. 3A-3B) and a viscosity adjustment screw 324 that protrudes from a face of the tube cap piston 322. The tube cap piston 322 and viscosity adjustment screw 324 are utilized to adjust the maximum fluid viscosity permitted to flow through the tube cap ports 228 of the tube cap 226.

Figure 4:
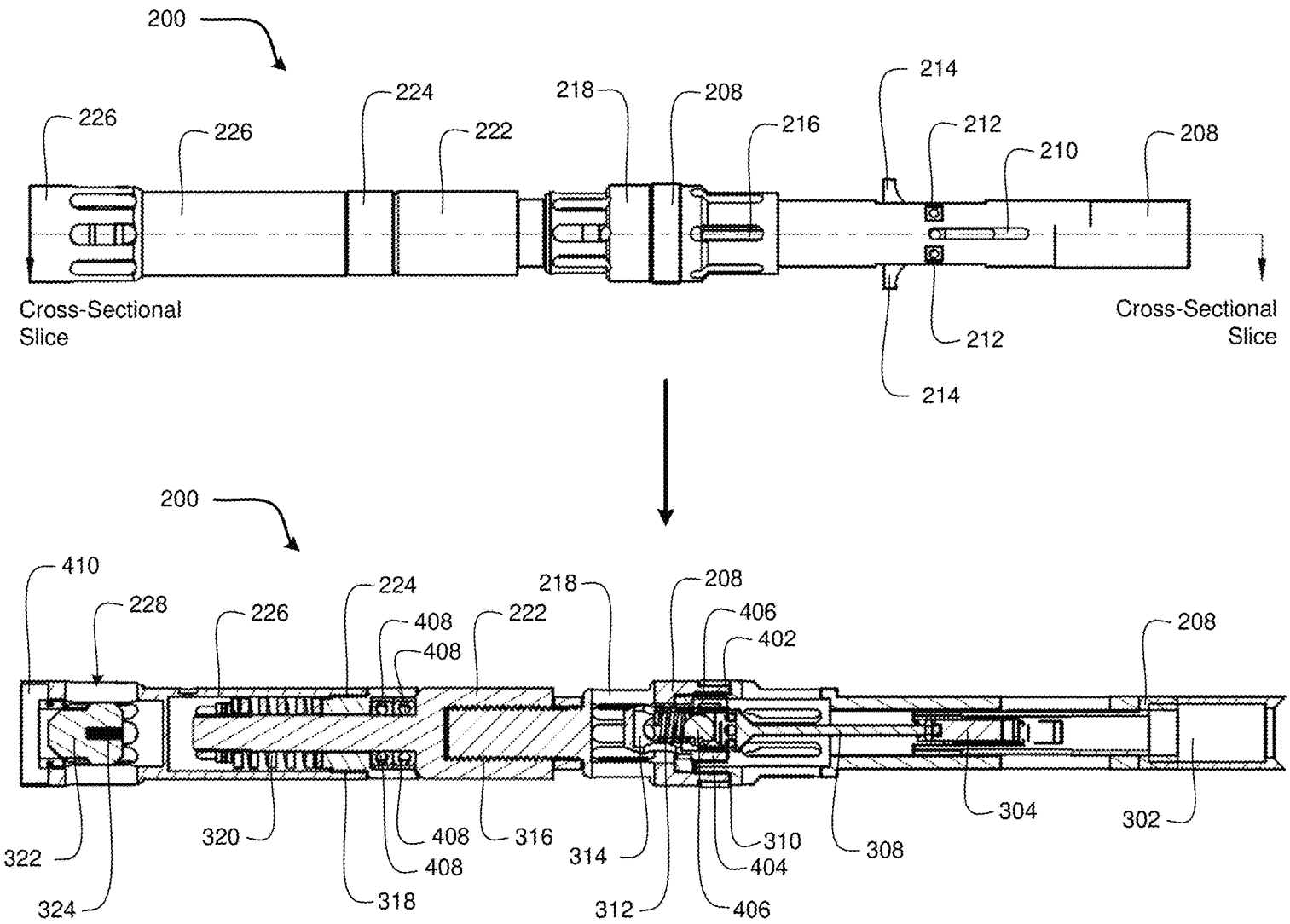
FIG. 4 is a cross-sectional side view of an assembly for performing a drilling operation.

FIG. 4 is a cross-sectional side view of the head assembly 200. The top image in FIG. 4 illustrates where the cross-sectional slice is taken, and the bottom image in FIG. 4 illustrates the resultant cross-sectional view.

FIG. 4 further illustrates the expansion block 304 disposed within an interior space defined by the sidewall of the upper body 208. As shown, the expansion block 304 is attached to the piston shaft 308, which is further attached to the fluid retention cage 402. As shown, the fluid retention cage 402 comprises a diameter that is larger than diameter of the piston shaft 308, and the fluid retention cage 402 includes numerous holes that permit fluid to flow into and out of the fluid retention cage 402.

The check valve assembly 204 of the head assembly 200 includes at least a valve bushing 404, a valve ball 406, the valve spring 312, and the retention piston 314. The piston cage is disposed within an interior space defined by the retention piston 314. The valve bushing is also disposed within the interior space of the retention piston 314, and the valve ball 406 is disposed within the interior space defined by the valve bushing 404. Each of the valve spring 312 and the valve ball 406 is also disposed within the interior space defined by a sidewall of the retention piston 314.

The head assembly 200 additionally includes one or more spacers 408 disposed between the spindle 222 and the shock absorber body 224. As shown in FIG. 4, the spacers 408 may be sized such that the spacers 408 are disposed in between a rod of the spindle 222 and a sidewall of the shock absorber body 224.

The tube cap assembly 206 includes at least the tube cap 226, tube cap port(s) 228, tube cap piston 322, viscosity adjustment screw 324, and terminating tube cap 410. As shown in FIG. 4, the tube cap piston 322 is disposed within an interior space defined by the substantially cylindrical hollow geometry of the tube cap 226. Additionally, the viscosity adjustment screw 324 is screwed into the tube cap piston 322. The terminating tube cap 410 is attached to an open end of the tube cap 226 to close off the head assembly 200.

Figure 5:
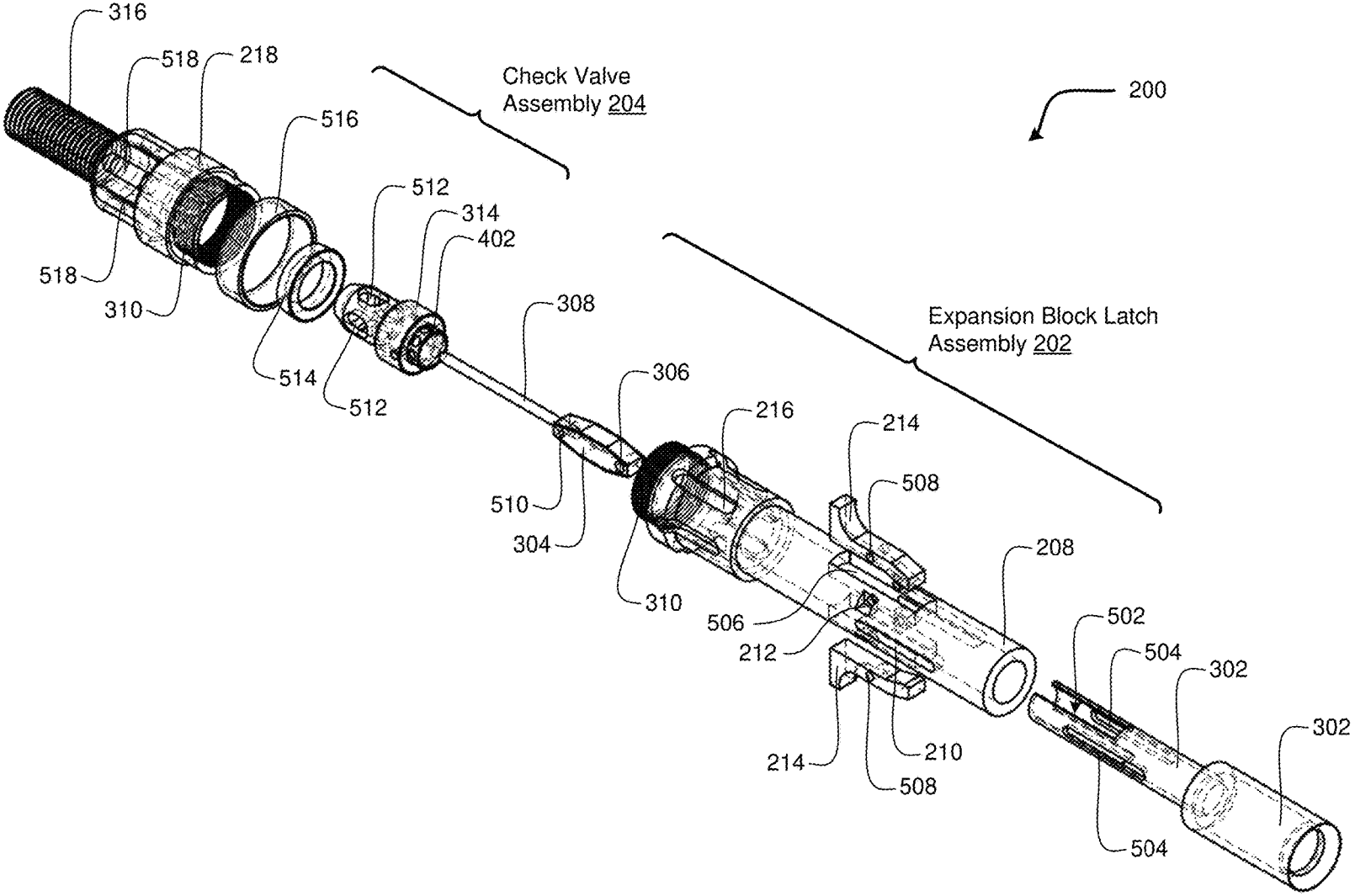
FIG. 5 is an exploded perspective view illustrating components of a latch assembly and check valve assembly for an assembly for performing a drilling operation.

FIG. 5 is an exploded perspective view illustrating components of the expansion block latch assembly 202 and check valve assembly 204 of the head assembly 200. FIG. 5 further illustrates components of the retractor case 302, which is configured to interface with an overshot (not shown) during a drilling operation.

The retractor case 302 includes a substantially cylindrical hollow geometry defined by a sidewall. The retractor case 302 includes one or more latch channels 502 disposed within the sidewall forming the substantially cylindrical geometry. The latch channel 502 is configured to receive the latch ear 214 when the retractor case 302 is disposed within the upper body 208. Thus, each of the one or more latch ears 214 can rotate about a pivot point because the latch channel 502 prevents the latch ear 214 from being obstructed by a sidewall of the retractor case 302. The retractor case 302 additionally includes one or more retractor pin slots 504. In most implementations, the retractor case 302 includes retractor pin slots 504 that are diametrically opposed to one another relative to the cylindrical geometry of the retractor case 302.

The upper body 208 includes one or more latch ear openings 506 disposed within a sidewall of the upper body 208. In most implementations, the head assembly 200 includes two latch ears 214 that are diametrically opposed to one another, and therefore the upper body 208 similarly includes two latch ear openings 506 that are diametrically opposed to one another. The latch ear opening 506 is configured to receive the latch ear 214 and thus enable the latch ear to rotate about its pivot point 508. The pivot point 508 of the latch ear 214 aligns with the body pivot hole 212 disposed within a sidewall of the upper body 208.

The expansion block latch assembly 202 includes the expansion block 304, which is responsible for causing rotation of the latch ears 214 about their pivot points 508. A pin (not shown) is disposed through a first body pin slot 210 on a first side of the upper body 208, and through a first retractor pin slot 504 on a first side of the retractor case 302, and through the expansion block pinhole 306, and through a second retractor pin slot 504 on a second (opposite) side of the retractor case 302, and through a second body pin slot 210 on a second (opposite) side of the upper body 208. The combination of the pin and the pin slots 210, 504 ensures that the expansion block 304 can only move from a downhole end of the pin slots 210, 504 to an uphole end of the pin slots 210, 504.

When the pin is located at the downhole end of the pin slots 210, 504, the expansion block 304 causes the latch ears 214 to extend outward in the latched position. When the latch ears 214 extend outward, at least a portion of the latch ears 214 will interface with a surrounding tube, such as the overshot 104 discussed in connection with FIG. 1. When the pin is located at the uphole end of the pin slots 210, 504, the expansion block 304 no longer presses against the latch ears 214, and the latch ears 214 are thus able to rotate about their pivot points 508 and inward toward the inner space of the upper body 208. When the latch ears 214 rotate inward, they are in the unlatched position and will no longer interface with the surrounding tube. This enables the head assembly 200 to be pulled out of the surrounding tube without incurring considerable damage to the expansion block latch assembly 202.

The expansion block 304 is attached to the piston shaft 308 at an attachment point 510. The piston shaft 308 is attached to the piston cage, and the piston cage is disposed within an interior space defined by the retention piston 314. The retention piston 314 includes one or more check valve ports 512 disposed within a sidewall of the retention piston 314. The check valve ports 512 enable fluid to flow into and out of the retention piston 314. When the check valve assembly 204 is in the open position, fluid is permitted to flow out through the check valve ports 512. When the check valve assembly 204 is in the closed position, fluid is prevented from flowing out through the check valve ports 512.

The head assembly 200 includes a float tension bushing 514 configured to be disposed around a portion of the retention piston 314. The head assembly 200 additionally includes a landing shoulder 516 located within a mid-region of the head assembly 200. The landing shoulder 516 interacts with a landing ring located within a core barrel during a drilling operation. The landing shoulder 516 stops the latch head assembly 202 portion of the head assembly 200 at the core barrel when the head assembly 200 is installed within the core barrel to perform the drilling operation. Following this, the retention piston 314 drops down to the float tension bushing 514 along with interacting parts attached to the piston shaft 308, the latch ear 214, and the pin slots 210. This thereby locks the head assembly 200 into place within the core barrel.

As shown in FIG. 5, the lower body 218 includes threading 310 that corresponds with the threading 310 on the upper body 208. When the exploded components illustrated in FIG. 5 are fully inserted, much of the check valve assembly 204 will be located at the overlapping point where the lower body 218 attaches to the upper body 208.

The lower body 218 includes lower body fluid ports 518 similar to the upper body fluid ports 216 associated with the upper body 208. When the check valve assembly 204 is in the open position, fluid is permitted to flow out through the check valve ports 512 of the retention piston 314, and further out through the lower body fluid ports 518 of the lower body 218.

Figure 6A:
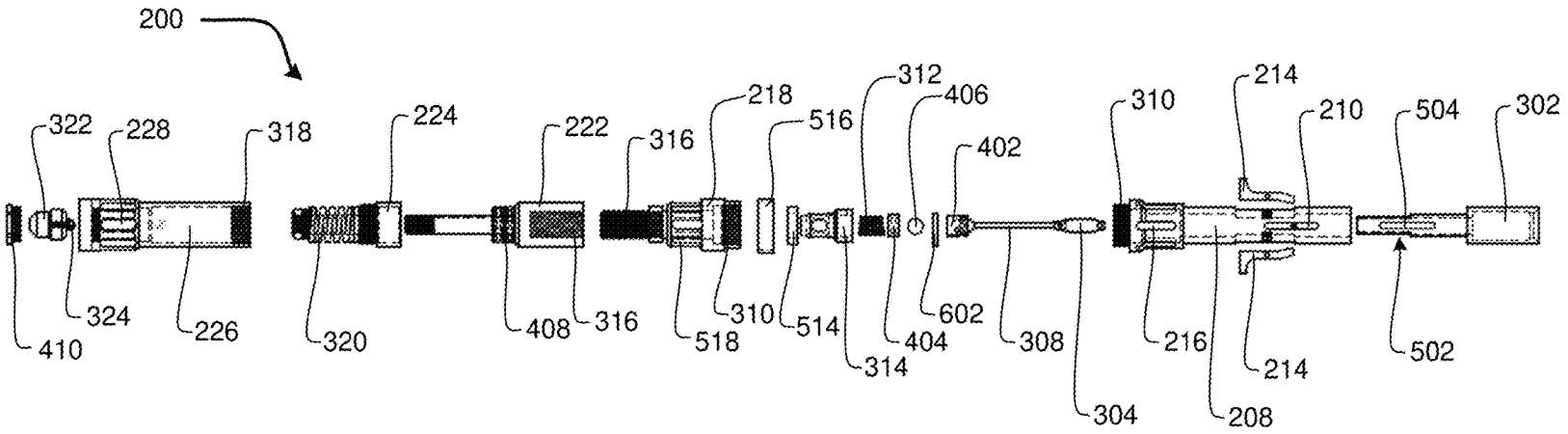
FIG. 6A is a straight-on exploded view of an assembly for performing a drilling operation.
Figure 6B:
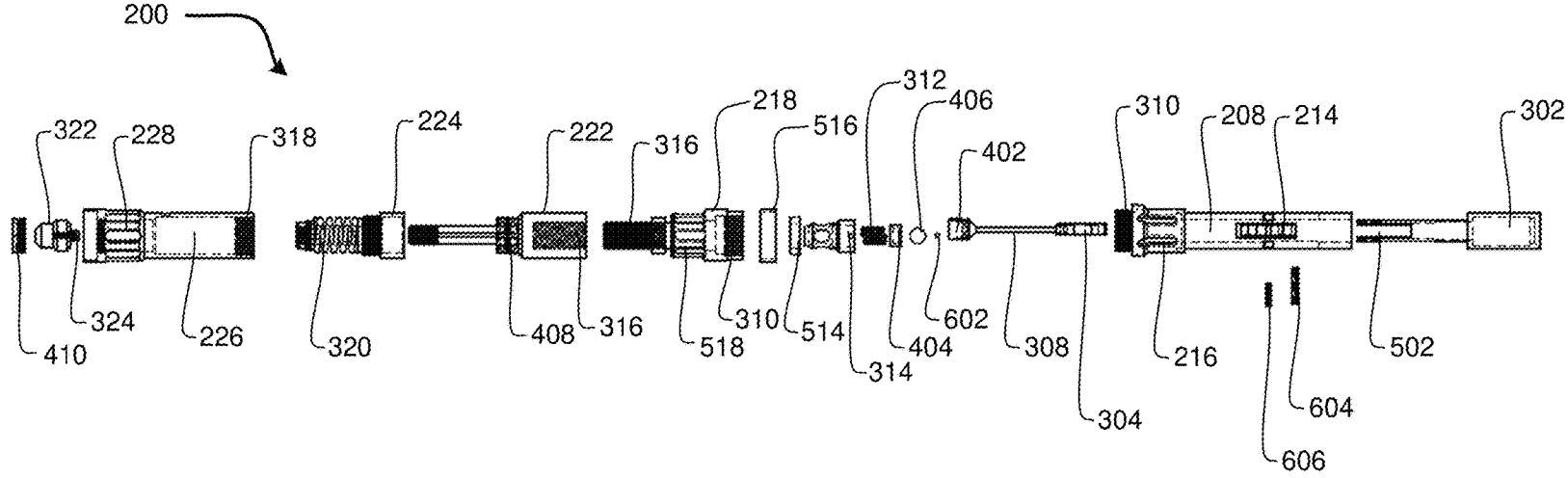
FIG. 6B is a straight-on exploded view of an assembly for performing a drilling operation, wherein the drill assembly is rotated ninety degrees relative to the view illustrated in FIG. 6A.

FIGS. 6A and 6B are straight-on exploded side views of the head assembly 200. Similar to the views illustrated in FIGS. 2A-2B, and in FIGS. 3A-3B, the head assembly 200 depicted in FIG. 6B is rotated 90 degrees about its longitudinal axis when compared with the illustration in FIG. 6A.

As shown in FIGS. 6A and 6B, the check valve assembly 204 portion of the head assembly 200 additionally includes a roll pin 602. The roll pin 602 is a consumable item that enables surrounding parts to be attached together.

FIG. 6B further illustrates the slot pin 604 and the pivot pin 606 of the expansion block latch assembly 202 portion of the head assembly 200. The slot pin 602 is configured to be disposed through the body pin slot(s) 210 of the upper body 208, through the retractor pin slot(s) 504 of the retractor case 302, and further through the expansion block pinhole 306 of the expansion block 304. The slot pin 604 slides up and down the pin slots 210, 504 to adjust the linear position of the expansion block 304. The pivot pin 606 is configured to be disposed through the body pivot hole 212 of the upper body 208, and further though the pivot point 510 of the expansion block 304. The latch ears 214 are configured to rotate about an axis located at the pivot point 510. The rotational position of the latch ears 214 determines whether the latch ears are in a latched or unlatched position.

Figure 7:
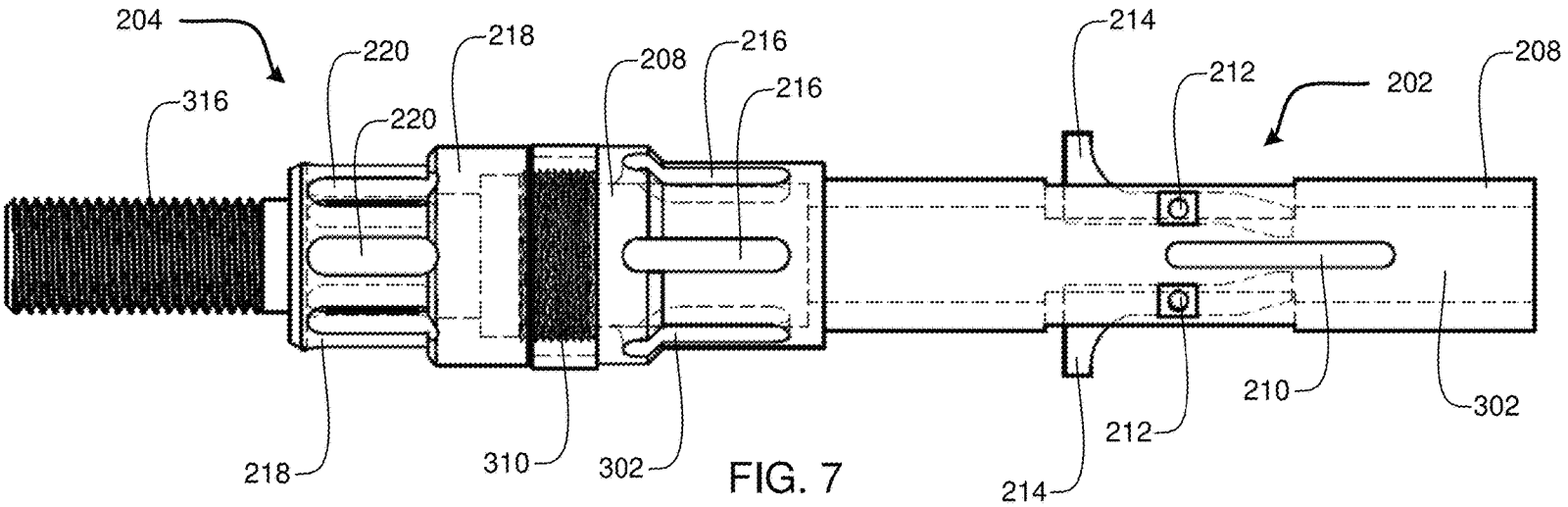
FIG. 7 is a wireframe straight-on side view of components of a latch assembly and check valve assembly of an assembly for performing a drilling operation.

FIG. 7 illustrates a wireframe straight-on side view of the check valve assembly 204 and expansion block latch assembly 202 portions of the head assembly 200. As shown in FIG. 7, the upper body 208 is attached to the lower body 218 by way of the threading 310. The upper body 208 and lower body 218 each include corresponding threading serving as a fastening mechanism for releasably attaching the upper body 208 to the lower body 218.

In some implementations, and as shown in FIG. 7, the downhole end of the body pin slot 210 is located at substantially the same longitudinal position as the body pivot holes 212. The relative locations of the body pivot holes 212 and the body pin slot 210 are optimized to ensure the latch ears 214 will rotate in and out of the latched position or unlatched position.

Figure 8:
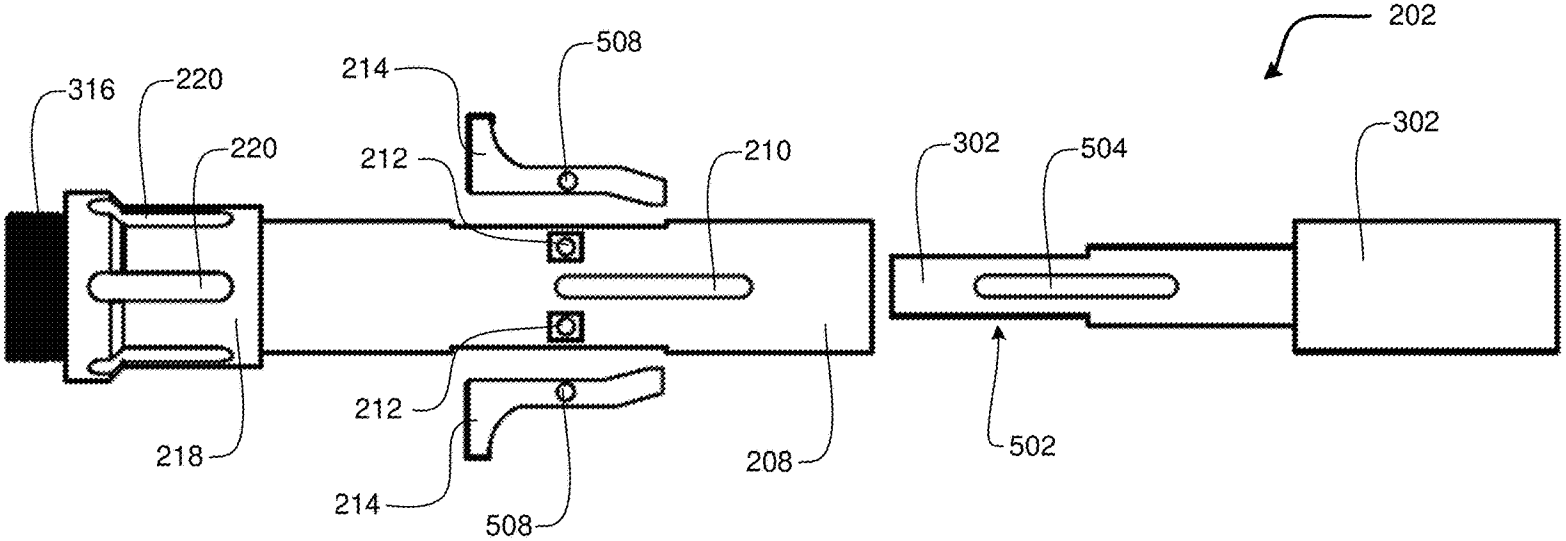
FIG. 8 is a straight-on side view of components of a latch assembly of an assembly for performing a drilling operation.

FIG. 8 illustrates a straight-on side view of the expansion block latch assembly 202 portion of the head assembly 200. As shown in FIG. 8, the length of the body pin slot 210 is substantially equivalent to the length of the retractor pin slot 504. This ensures that a single slot pin (see 604 first illustrated at FIG. 6B) can be disposed through each of the upper body 208 and the retractor case 302 and may slide back and forth along the longitudinal axis of the head assembly 200.

Figure 9A:
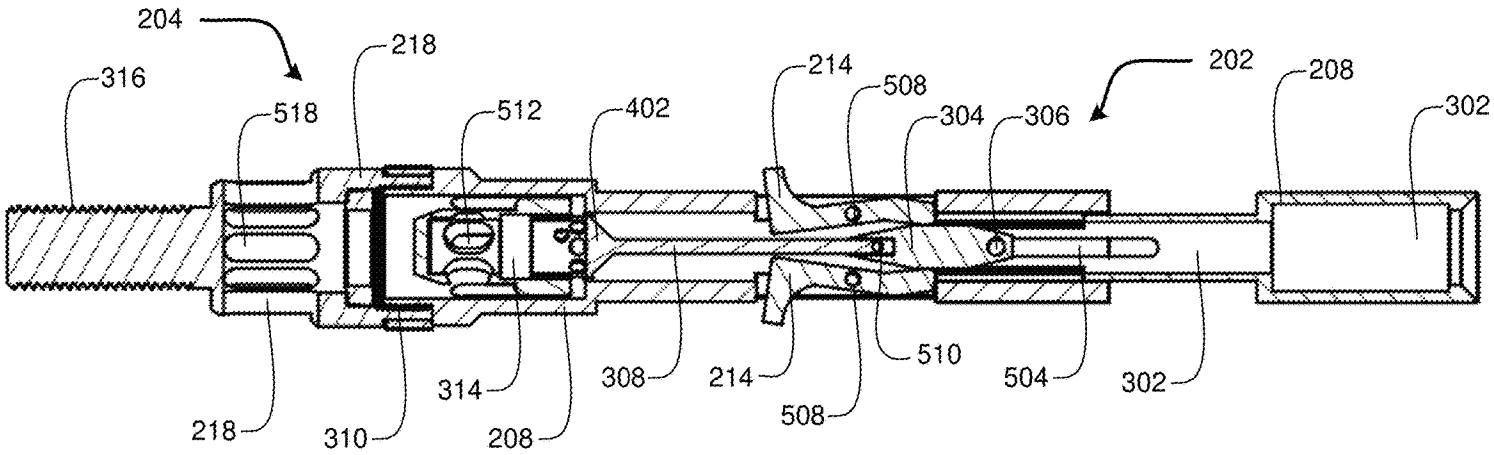
FIG. 9A is a cross-sectional side view of components of a latch assembly and check valve assembly of an assembly for performing a drilling operation, wherein the latch assembly is in the unlatched configuration.
Figure 9B:
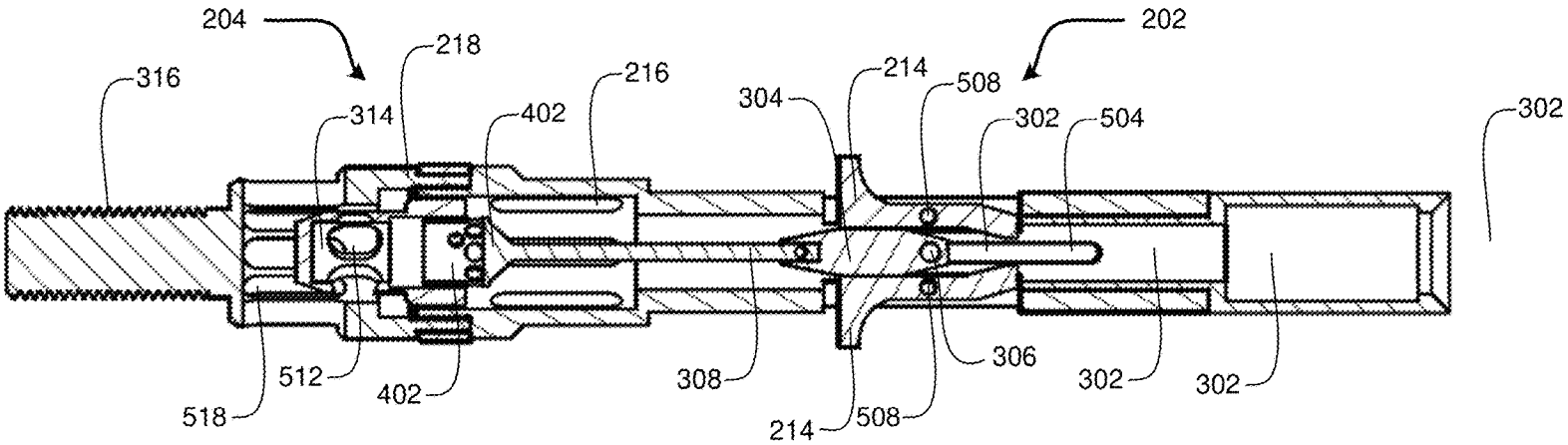
FIG. 9B is a cross-sectional side view of components of a latch assembly and check valve assembly of an assembly for performing a drilling operation, wherein the latch assembly is in the latched configuration.

FIGS. 9A and 9B are cross-sectional side view of the expansion block latch assembly 202 and check valve assembly 204 portions of the head assembly 200. FIG. 9A illustrates wherein the expansion block latch assembly 202 is in an unlatched configuration, and FIG. 9B illustrates wherein the expansion block latch assembly 202 is in a latched position.

When the expansion block latch assembly 202 is in the unlatched configuration, as shown in FIG. 9A, the expansion block 304 is pulled toward the uphole end of the head assembly 200. When this occurs, the geometry of the expansion block 304 enables the latch ears 214 to rotate about the pivot point 508 and fall inward toward a center of the upper body 208. When the latch ears 214 fall inward, they will no longer form an interference fit with a tube (not shown) that surrounds the head assembly 200.

When the expansion block latch assembly 202 is in the latched configuration, as shown in FIG. 9B, the expansion block 304 is pulled toward the downhole end of the head assembly 200. When this occurs, the geometry of the expansion block 304 forces the latch ears 214 to rotate about the pivot point 508 such that a radial arm portion of the latch ears 214 extends radially outward relative to the cylindrical geometry of the upper body 208, as shown in FIG. 9B. When this occurs, the arm portion of each latch ear 214 will form an interference fit with the interior surface of a tube (not shown) that surrounds the head assembly 200.

Figure 10:
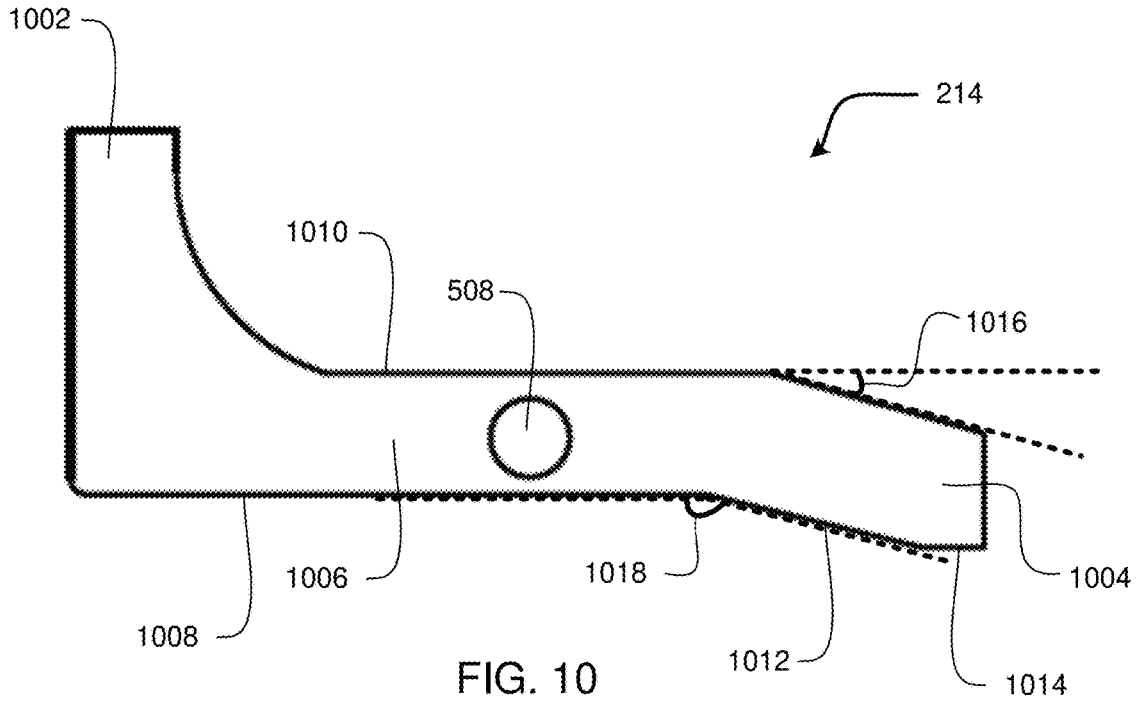
FIG. 10 is a schematic illustration of a latch ear to be utilized as a component of a latch assembly of an assembly for performing a drilling operation.

FIG. 10 is a schematic illustration of a latch ear 214 to be utilized as a component of the expansion block latch assembly 202 portion of the head assembly 200. The latch ear 214 includes the pivot point 508, which is a hole disposed through the body of the latch ear 214. The pivot point 508 is configured to receive the pivot pin (see 606 first illustrated at FIG. 6B), and this enables the latch ear 214 to rotate about an axis of rotation centered on the pivot point 508.

The latch ear 214 includes a main body 1006. When the latch ear 214 is in the latched configuration, the main body 1006 is oriented substantially parallel to a longitudinal axis of the head assembly 200. The latch ear 214 includes a radial arm 1002 portion attached to the main body 1006. When the latch ear 214 is in the latched configuration, the radial arm 1002 is located substantially perpendicular to the longitudinal axis of the head assembly 200, and further extends substantially radially outward relative to the cylindrical geometry of the upper body 208. The latch ear 214 additionally includes leg 1004 portion attached to the main body 1006. The leg 1004 is located at an opposite end of the main body 1006 relative to the radial arm 1002.

The latch ear 214 includes a latching surface 1008 running along the main body 1006. The latching surface 1008 is configured to interface with a corresponding surface of the expansion block 304. The latch ear 214 includes an external longitudinal surface 1010 that is located opposite to the latching surface 1008 relative to the main body 1006. The latch ear 214 includes a leg surface 1012 running along the internal side of the leg 1004. The latch ear 214 includes a leg stop surface 1014 located at an edge of the leg 1004.

The bend of the leg 1004 relative to the main body 1006 forms interior-side angle 1018 and an exterior-side angle 1016. The interior-side angle 1018 is from about 100 degrees to about 170 degrees. The exterior-side angle 1016 is measured as an exterior angle as shown in FIG. 10, such that a first ray of the exterior-side angle 1016 runs along a surface of the leg 1004, and a second ray of the exterior-side angle 1016 is parallel to the external longitudinal surface 1010 of the main body 1006. The exterior-side angle 1016 is from about 20 degrees to about 60 degrees.

Figure 11:
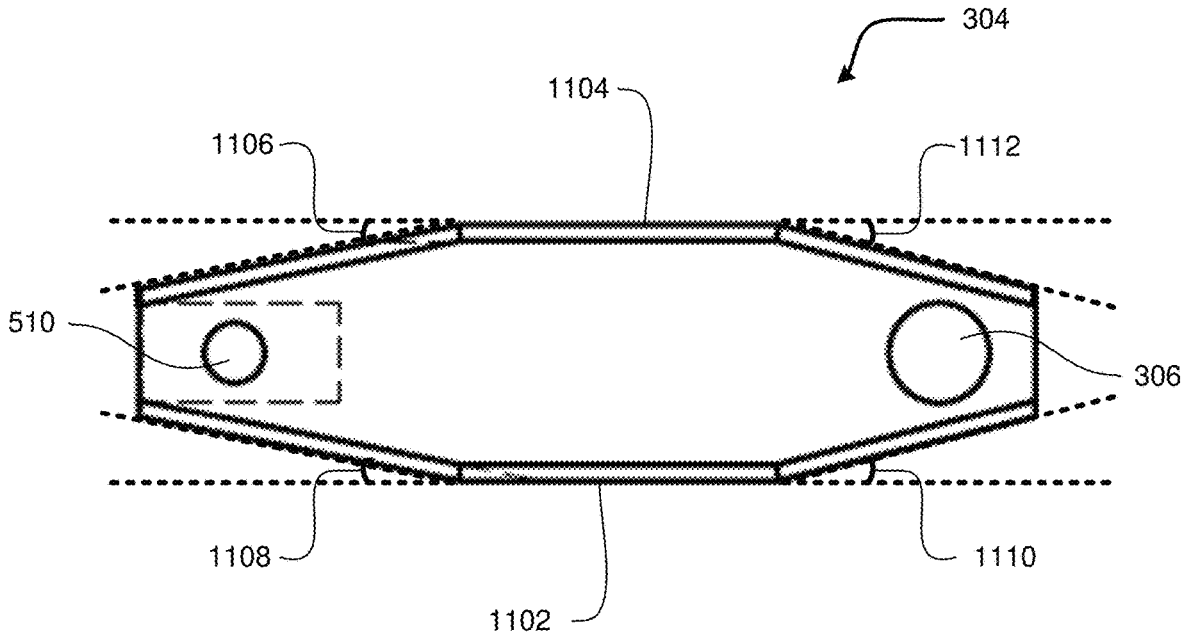
FIG. 11 is a schematic illustration of an expansion block to be utilized as a component of a latch assembly of an assembly for performing a drilling operation.

FIG. 11 is a schematic illustration of the expansion block 304 to be utilized as a component of the expansion block latch assembly 202 portion of the head assembly 200. The expansion block 304 includes the expansion block pinhole 306 that is configured to receive the slot pin (see 604 first illustrated at FIG. 6B). The expansion block 304 further includes the attachment point 510 configured for attaching the expansion block to the piston shaft 308 (not shown in FIG. 11).

The expansion block 304 includes a first latching surface 1102 and a second latching surface 1104. The first latching surface 1102 and the second latching surface 1104 are diametrically opposed to one another relative to the body of the expansion block 304, as shown in FIG. 11. The first latching surface 1102 is configured to press against a latching surface 1008 of a first latch ear 214, and the second latching surface 1104 is configured to press against a latching surface 1008 of a second latch ear 214. When the latching surfaces 1102, 1104 of the expansion block 304 are pressing against corresponding latching surfaces 1008 of corresponding latch ears 214, then the latching assembly 202 will be in the latched configuration, as shown in FIG. 9B.

The expansion block 304 includes a polygonal geometry and may specifically include an irregular octagonal geometry as shown in FIG. 11. In alternative implementations, the expansion block 304 may include a quadrilateral geometry, pentagonal geometry, or hexagonal geometry. The number of sides on the expansion block 304 may be adjusted and optimized as needed depending on the implementation. The expansion block 304 comprises a convex polygonal geometry as shown in FIG. 11. The expansion block 304 includes a plurality of convex exterior angles as shown in FIG. 11, and may specifically include a first exterior angle 1106, second exterior angle 1108, third exterior angle 1110, and fourth exterior angle 1112 as identified in FIG. 11. The exterior angles of the expansion block 304 are measured as shown in FIG. 11 and are specifically measured as the angle formed between a first side of the polygonal geometry, and another line that is formed by extending a second side that is adjacent to the first side.

Each of the exterior angles 1106, 1108, 1110, 1112 may include an angle from about 20 degrees to about 60 degrees. In an implementation, each of the exterior angles 1106, 1108, 1110, 1112 is substantially identical. In a further implementation, one or more of the exterior angles 1106, 1108, 1110, 1112 is substantially identical to the exterior-side angle 1016 of the latch ear 214. In a further implementation, a sum of the interior-side angle 1018 of the latch ear 214, and one of the exterior angles 1106, 1108, 1110, 1112 of the expansion block 304, is substantially equal to 180 degrees.

Retracting the latch ears 214 is useful in many applications. A first application is when the head assembly is run in-hole. The latch ears 214 may be retracted (i.e., moved into the unlatched configuration) to prevent the latch ears 214 from dragging along the interior surface of a tube disposed around the head assembly 200. Dragging any component causes wear which can lead to failure that may cause an expensive and time-consuming repair. A second useful application is to release the head assembly 200 from a latched configuration as the head assembly 200 and a core barrel (or any other equipment) is being pulled up and out of the hole. In some implementations, an overshot latches onto the retractor case 302 and thereby pulls on the head assembly 200. Thus, pulling up on the retractor case 302 may cause the slot pin 604 to move up the pin slots 210, 504. The slot pin 604 is connected to the expansion block 304, which moves uphole. Thus, moving the expansion block 304 uphole causes the expansion block 304 to retract the latching surface of the latch ears 214. Accordingly, pulling on the retractor case 302 will cause the latch ears 214 to retract and enable an operator to lift the head assembly more easily 102 from the hole.

Figure 12A:
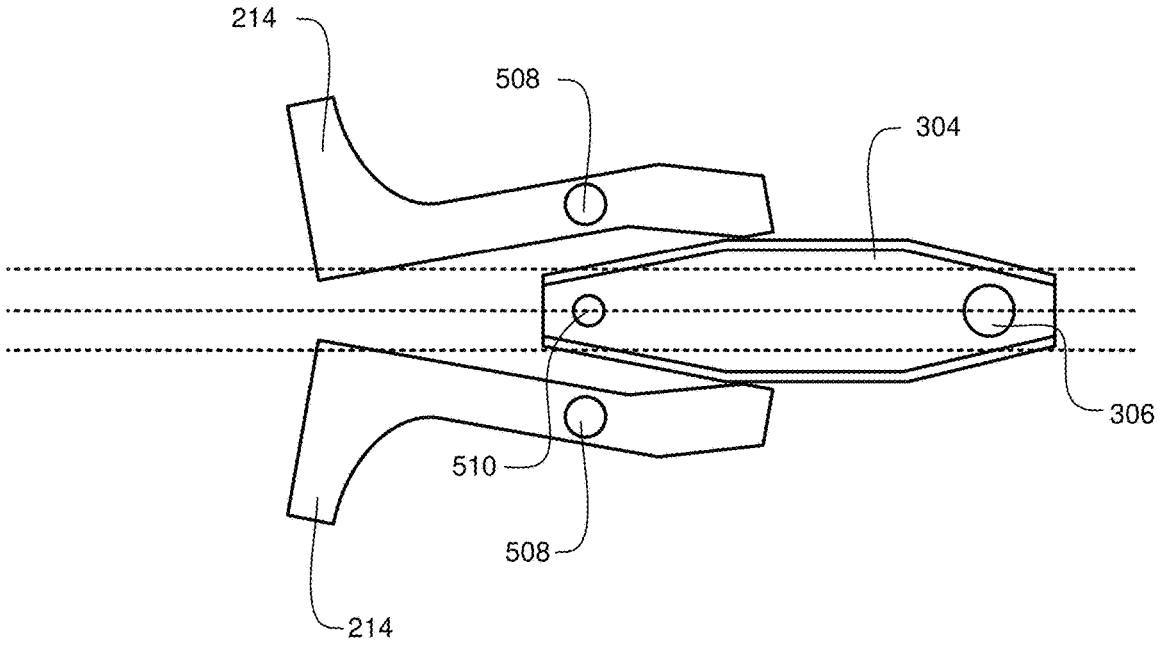
FIG. 12A is a schematic illustration depicting interactions between a latch ear and an expansion block of a latch assembly of an assembly for performing a drilling operation, wherein the latch ear is in an unlatched configuration.
Figure 12B:
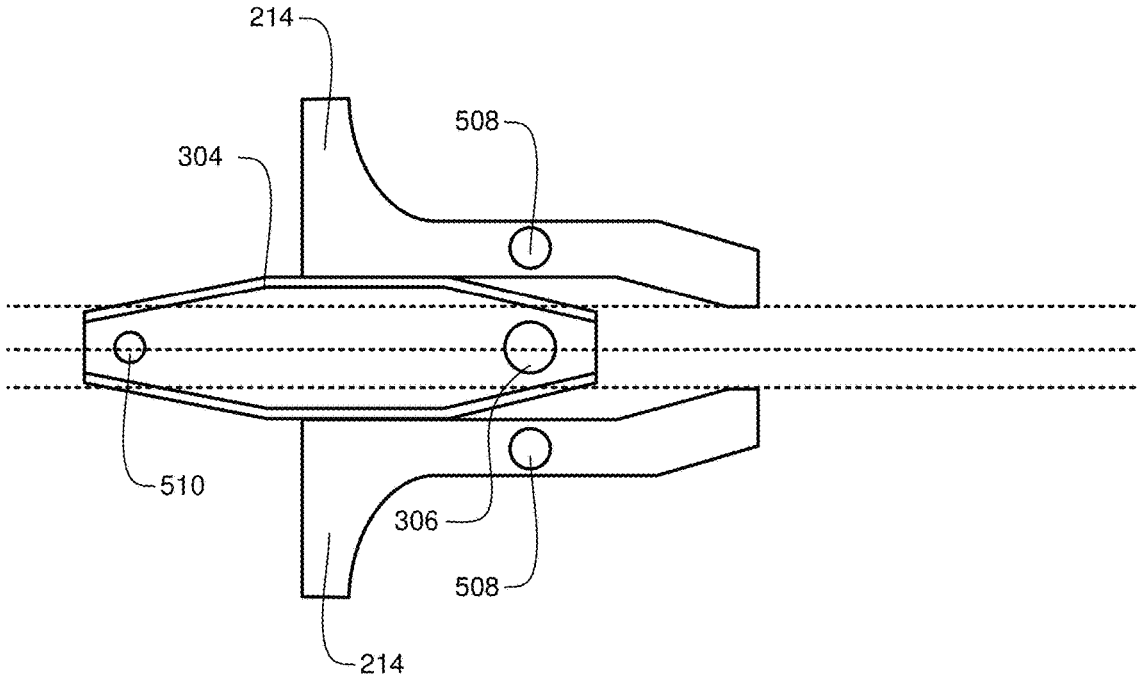
FIG. 12B is a schematic illustration depicting interactions between a latch ear and an expansion block of a latch assembly of an assembly for performing a drilling operation, wherein the latch ear is in a latched configuration.

FIGS. 12A and 12B are schematic illustration depicting interactions between the latch ear 214 and expansion block 304 of the expansion block latch assembly 202 portion of the head assembly 200. FIG. 12A illustrates wherein the latch ear 214 is in the unlatched configuration, with the expansion block 304 located toward the uphole end of the pin slot. FIG. 12B illustrates wherein the latch ear 214 is in the latched configuration, with the expansion block 304 located toward the downhole end of the pin slot. The dotted lines in FIGS. 12A and 12B are included to provide context to the rotation of the latch ears 214 about the pivot points 508.

As shown in FIGS. 12A and 12B, the latch ears 214 are configured to rotate "inward" toward an interior space defined by the substantially cylindrical hollow geometry of the upper body 208. When this occurs, the radial arm portions of the latch ears 214 are located nearer to the upper body 208, and thus will no longer form an interference fit with a tube surrounding the head assembly 200. The latch ears 214 are forced to rotate in the opposite direction when the expansion block 304 is disposed in between the diametrically opposed latch ears 214, as shown in FIG. 12B. This causes the radial arm portions of the latch ears 214 to form an interference fit with the tube surrounding the head assembly 200.

Figure 13:
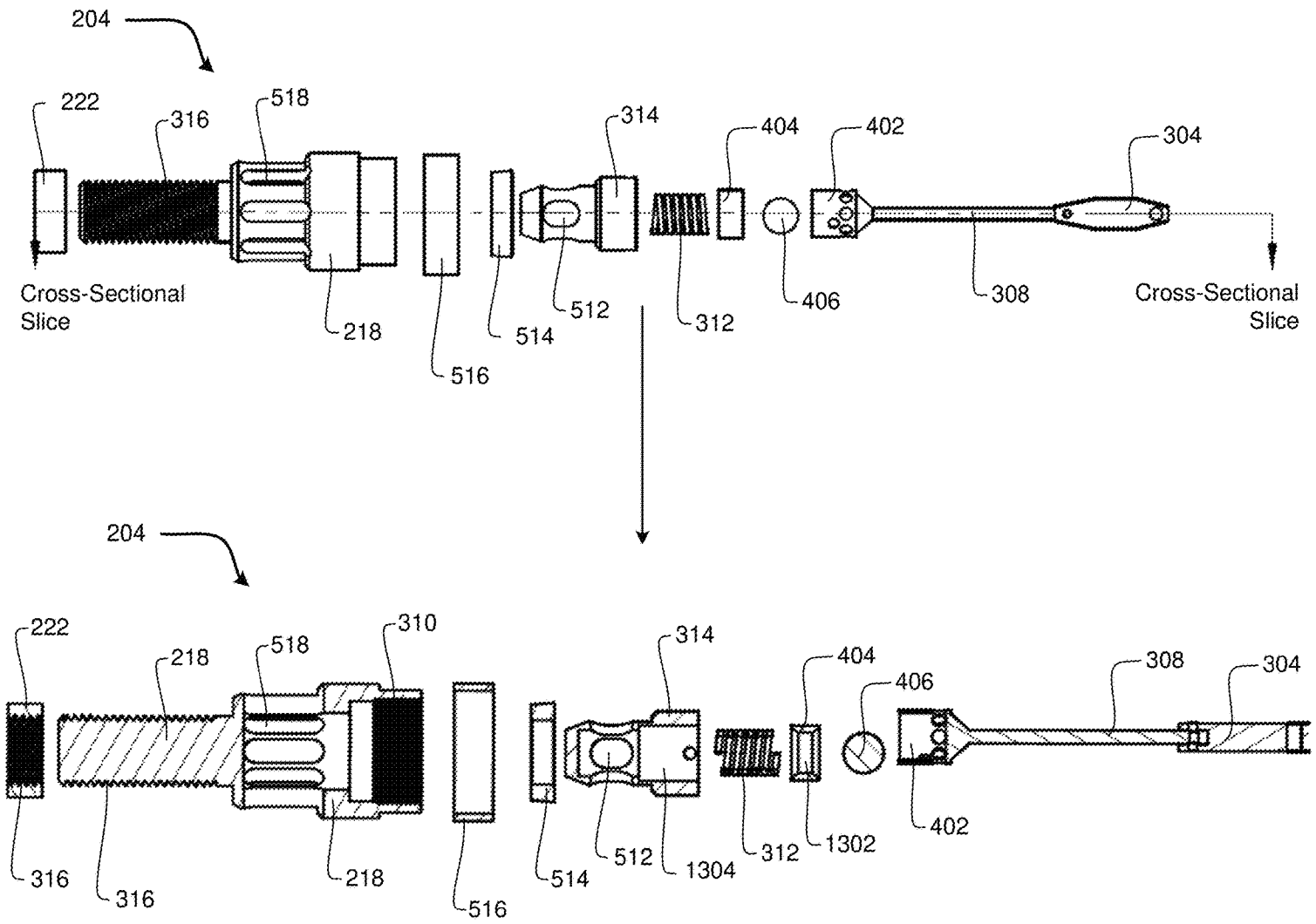
FIG. 13 is a cross-sectional exploded view of components of a check valve assembly portion of an assembly for performing a drilling operation.

FIG. 13 is a cross-sectional exploded view of the check valve assembly 204 portion of the head assembly 200. The top image in FIG. 13 illustrates the cross-sectional slice line made through the head assembly 200, and the bottom image in FIG. 13 illustrates the resultant cross-sectional view.

As shown in FIG. 13 the valve bushing 404 forms a bushing interior space 1302. The bushing interior space 1302 is configured to receive the valve ball 406. In some implementations, an interior diameter of the valve bushing 404 (i.e., a diameter of the bushing interior space 1302) is substantially equal to a diameter of the valve ball 406. Further as shown in FIG. 13, the retention piston 314 forms a valve interior space 1304. The size of the valve interior space 1304 is optimized such that the retention piston 314 receives each of the valve spring 312, the valve bushing 404, the valve ball 406, and at least a portion of the fluid retention cage 402. As discussed previously, the retention piston 314 includes a plurality of check valve ports 512 that permit fluid to flow into and out of the interior space defined by the retention piston 314.

Figure 14:
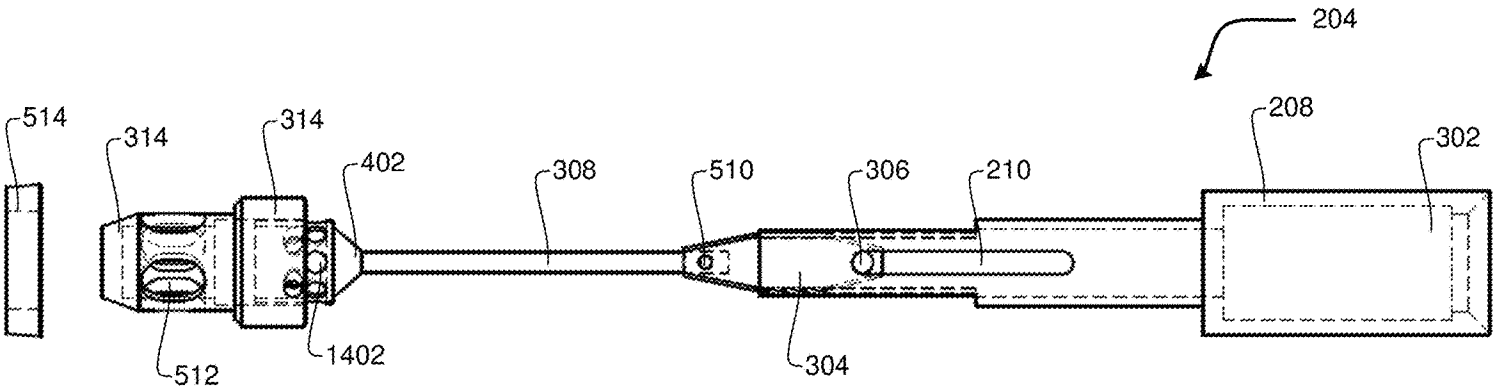
FIG. 14 is a wireframe straight-on side view of portions of a check valve assembly of an assembly for performing a drilling operation.
Figure 15:
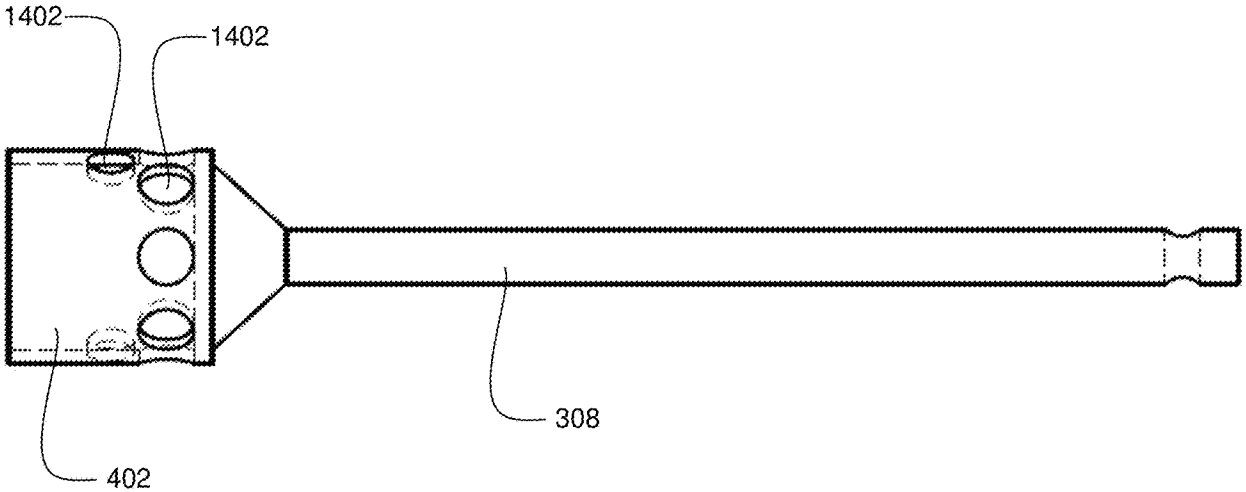
FIG. 15 is a straight-on side view of a piston shaft and piston cage to be utilized as a component of an assembly for performing a drilling operation.

FIG. 14 illustrates a wireframe straight-on side view of portions of the check valve assembly 204 portion of the head assembly 200. FIG. 15 is a straight-on side view of the piston shaft 308 and fluid retention cage 402. FIG. 14 specifically illustrates how the fluid retention cage 402 is partially disposed within an interior space defined by the retention piston 314. FIGS. 14 and 15 further illustrate that the fluid retention cage 402 includes a plurality of cage holes 1402 disposed through a sidewall of the fluid retention cage 402. The cage holes 1402 permit fluid to flow into and out of the fluid retention cage 402.

Figure 16:
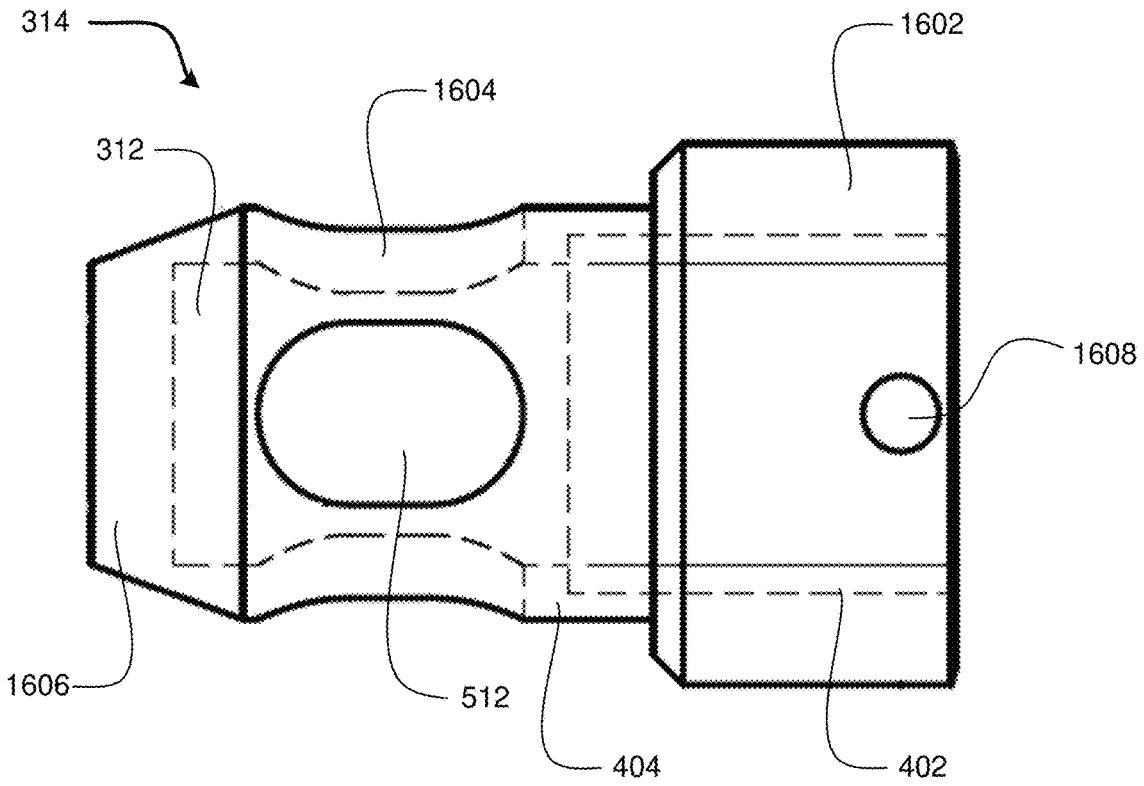
FIG. 16 is a wireframe straight-on wide view of a retention piston of a check valve assembly of an assembly for performing a drilling operation.

FIG. 16 is a wireframe straight-on side view of the retention piston 314 of the check valve assembly 204 portion of the head assembly 200. The dotted lines in FIG. 16 illustrate where other components of the check valve assembly 204, like the valve spring 312, valve bushing 404, and fluid retention cage 402 would approximately be located within an interior space defined by the retention piston 314.

The retention piston 314 includes a barrel portion 1602, a valve portion 1604, and an end portion 1606. The retention piston 314 further includes a roll pin 1608 that is configured to attach the piston shaft 308 to the piston.

Figure 17:
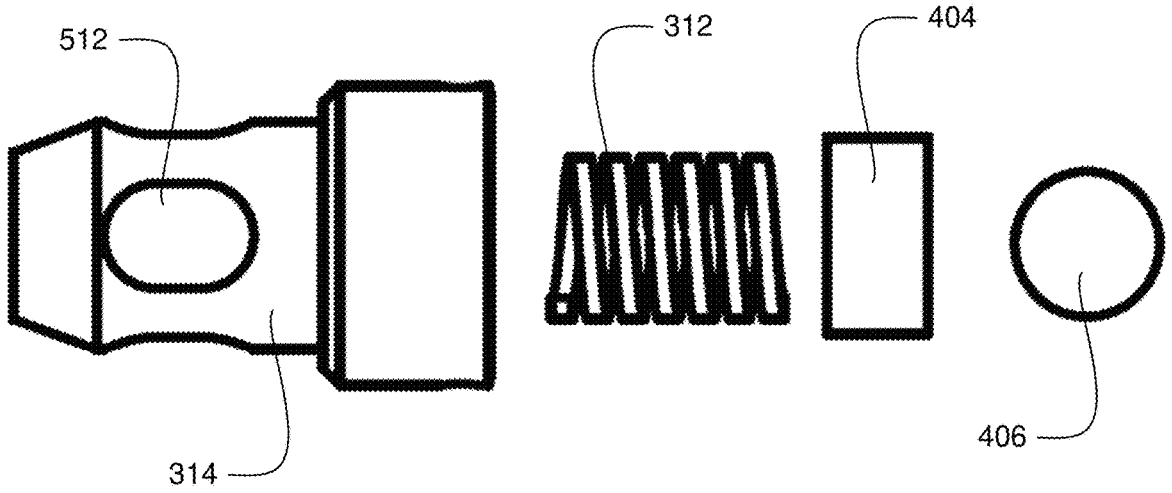
FIG. 17 is a straight-on exploded side view of components of a check valve assembly portion of an assembly for performing a drilling operation.

FIG. 17 is a straight-on exploded side view of components of the check valve assembly 204 portion of the head assembly 200. The check valve assembly 204 is configured to be in an open position or a closed position, depending on the current location of the valve ball 406 within the retention piston 314. Each of the valve spring 312, valve bushing 404, and valve ball 406 is configured to be disposed within an interior space defined by the retention piston 314. When the check valve assembly 204 is in the closed configuration, the position of the valve ball 406 blocks the flow of fluid through the check valve ports 512. When the check valve assembly 204 is in the open configuration, the position of the valve ball 406 permits the flow of fluid through the check valve ports 512.

Figure 18A:
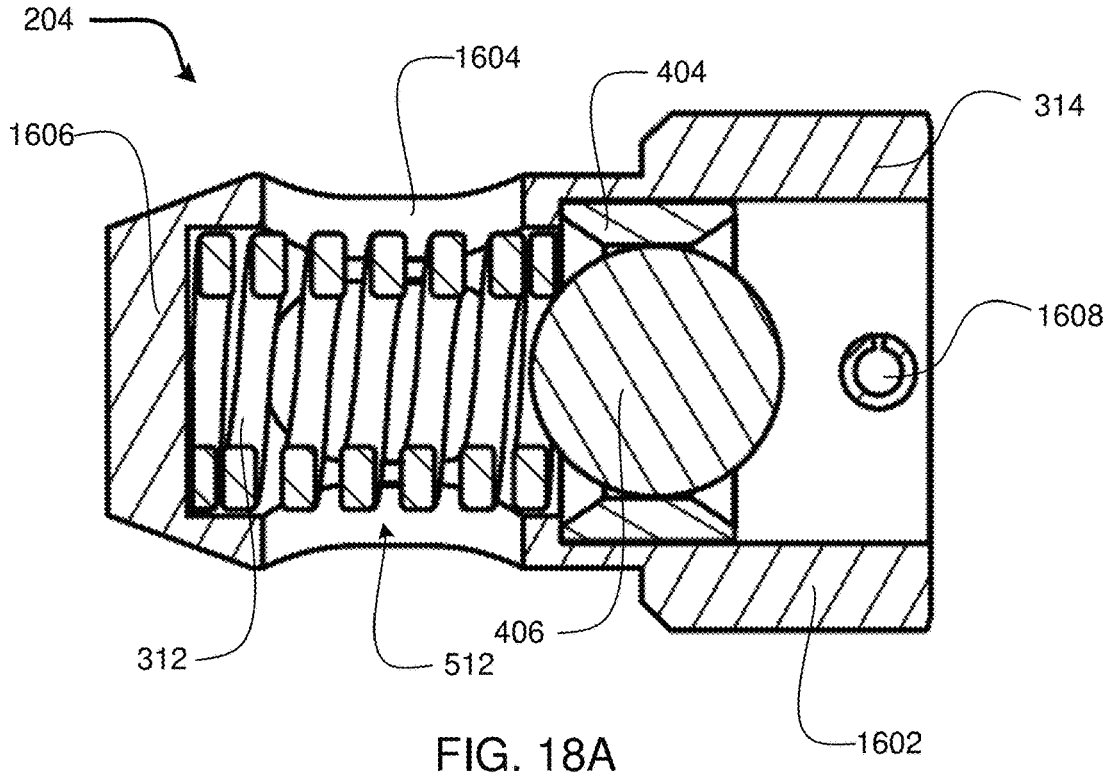
FIG. 18A is a cross-sectional straight-on side view of components of a check valve assembly portion of an assembly for performing a drilling operation, wherein the check valve assembly is in the closed configuration.
Figure 18B:
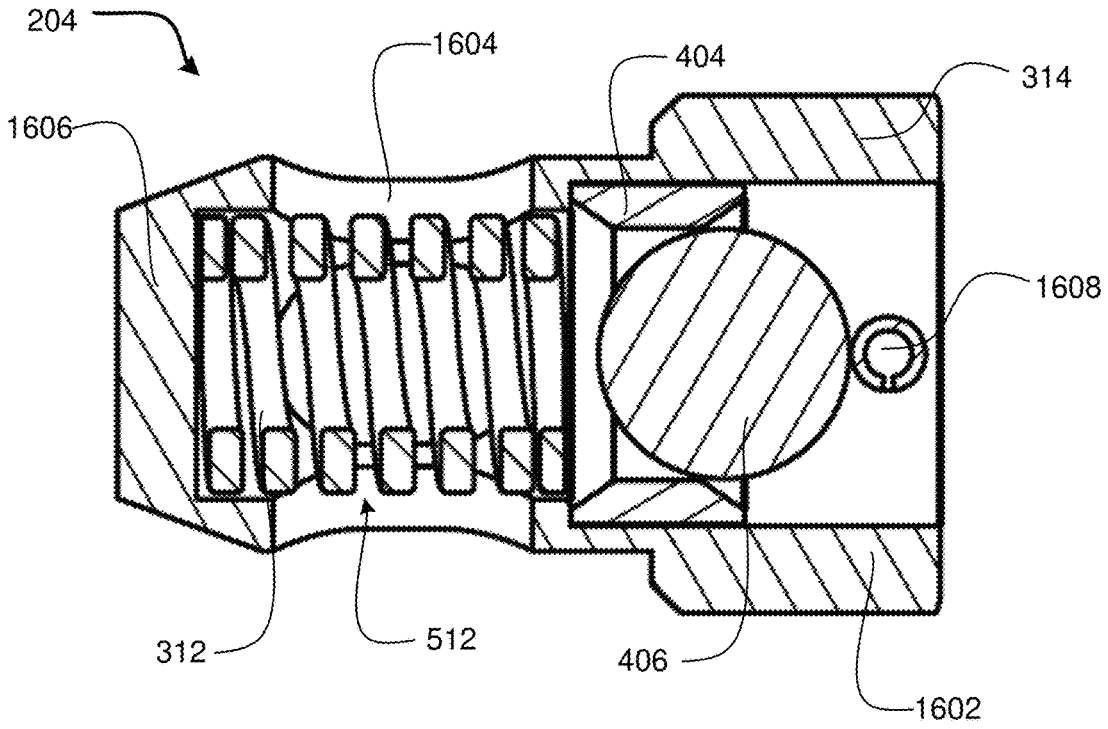
FIG. 18B is a cross-sectional straight-on side view of components of a check valve assembly portion of an assembly for performing a drilling operation, wherein the check valve assembly is in the closed configuration.

FIGS. 18A and 18B are cross-sectional straight-on side views of components of the check valve assembly 204 portion of the head assembly 200. FIG. 18A illustrates wherein the check valve assembly 204 is in the closed configuration, and thus prevents fluid from flowing through the valve bushing 404 and out through check valve ports 512 of the retention piston 314. FIG. 18B illustrates wherein the check valve assembly 204 is in the open configuration, and thus permits fluid to flow through the valve bushing 404 and out through the check valve ports 512 of the retention piston 314.

As shown in FIGS. 18A and 18B, the valve bushing 404 rests on an end of the valve spring 312 and is located uphole relative to the valve spring 312. Additionally, the valve ball 406 rests on an end of the valve spring 312 and is located uphole relative to the valve spring 312. In some implementations, the valve spring 312 fits into an interior space defined by the valve bushing 404, such that the valve ball 406 rests on an end of the valve spring 312 even when the check valve assembly 204 is in the open configuration. The valve ball 406 is given some clearance to move freely within the retention piston 314, such that debris may be washed out of the head assembly 200 and retention piston 314 during operation.

As disclosed in connection with FIG. 13, the valve bushing 404 comprises a bushing interior space 1302. In an implementation, the diameter of the bushing interior space 1302 is substantially equal to a diameter of the valve ball 406. Thus, when the valve ball 406 is disposed within the valve bushing 404, the exterior surface of the valve ball 406 forms a tight interference fit with an interior surface of the bushing interior space 1302. This tight interference fit may be fluid-tight and thus prevent the flow of fluid through the bushing interior space 1302. Thus, when the valve ball 406 is disposed within the valve bushing 404 as shown in FIG. 18A, fluid is prevented from flowing through the valve bushing 404, and the check valve assembly 204 is thereby in the closed configuration.

The check valve assembly 204 may be opened during a drilling operation by applying an external force to the valve ball 406. This external force is typically applied by pumping pressurized fluid into the interior space defined by the various components of the head assembly 200. If the force applied by the pressurized fluid exceeds a valve threshold, then the pressurized fluid will cause the valve to open. In one implementation, the pressurized fluid will create sufficient force to overcome the valve spring's 312 neutral position allowing the valve ball 406 to slide through the valve bushing 404. When the valve ball 406 passes through the valve bushing 404, fluid is then permitted to flow through the valve bushing 404, flow around the valve ball 406, and flow out through the check valve ports 512. Thus, the check valve assembly 204 is in the open configuration. In one implementation, the check valve assembly 204 is in the open configuration when the valve ball 406 is located downhole relative to the valve bushing 404. In another implementation, the check valve assembly 204 is in the open configuration when the valve ball 406 is located uphole relative to the valve bushing 404.

The check valve assembly 204 may be closed during a drilling operation by ceasing to apply the external force, or by decreasing the external force such that the magnitude of the external force fails to satisfy the valve threshold. When the force applied by the pressurized fluid fails to meet the valve threshold, then the valve spring 312 will decompress to its neutral position and the valve ball 406 will return to its resting position within and with respect to the valve bushing 404 as illustrated in FIG. 18A. In one implementation, the valve ball 406 moves toward the uphole end of the head assembly 200 into the closed configuration when the valve spring 312 returns to its neutral position. In another implementation, the valve ball 406 moves toward the downhole end of the head assembly 200 into the closed configuration when the valve spring 312 returns to its neutral position. The valve ball 406 is positioned back to its resting state and held in place by gravitational forces within the bushing interior space 1302 defined by the valve bushing 404 into a closed position.

Figure 19:
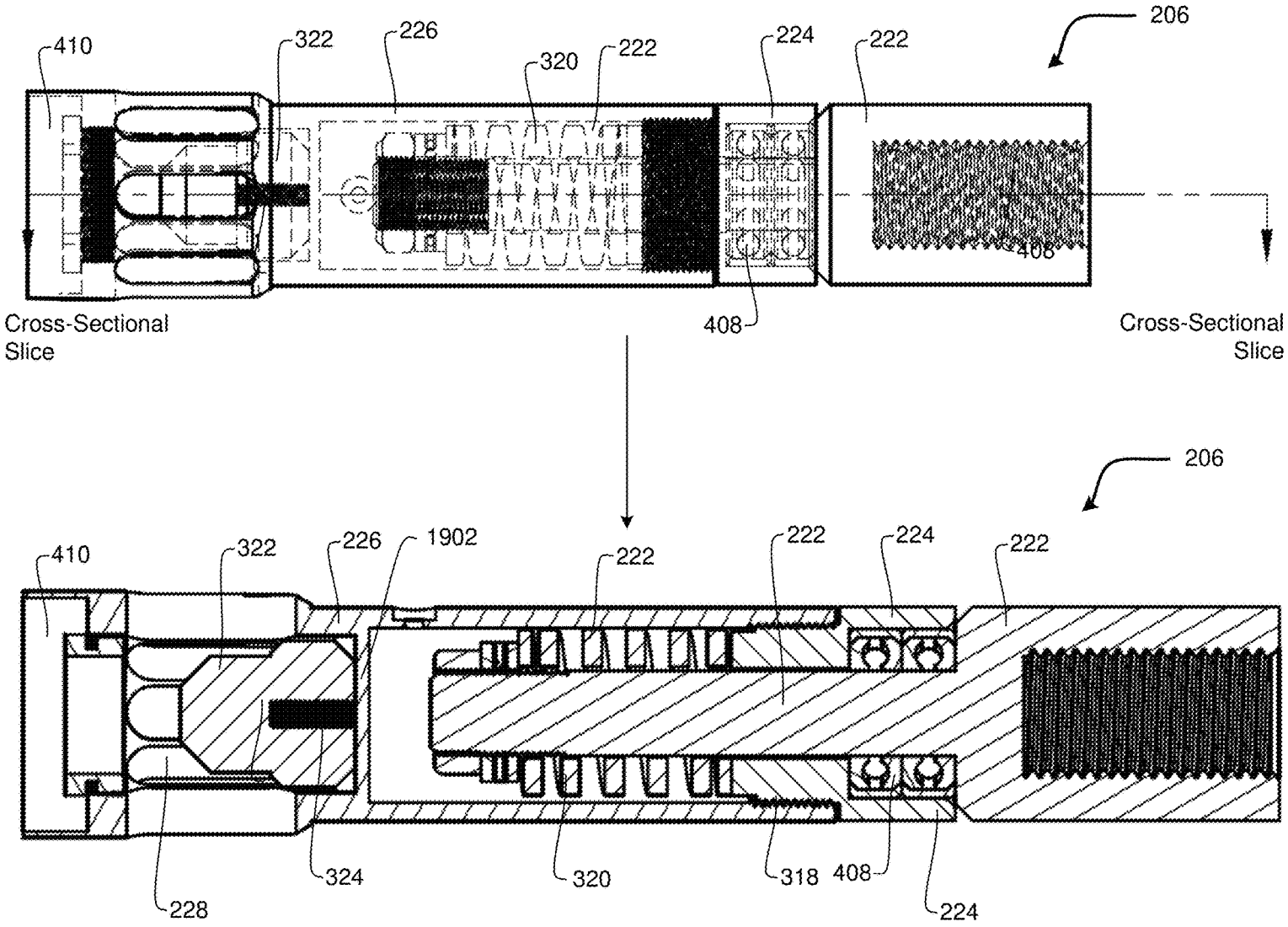
FIG. 19 is a cross-sectional straight-on side view of component of a tube cap assembly is a cross-sectional straight-on side view of components of a check valve assembly portion of an assembly for performing a drilling operation, wherein the check valve assembly is in the closed configuration.

FIG. 19 is a cross-sectional straight-on side view of components of the tube cap assembly 206 portion of the head assembly 200. The top image in FIG. 19 illustrates where the cross-sectional slice is taken within the tube cap assembly 206, and the bottom image in FIG. 19 illustrates the cross-sectional view.

As shown in the cross-sectional view, the spindle 222 is located adjacent to the shock absorber body 224, and a shaft of the spindle 222 is disposed within the shock absorber 320. Thus, the shaft of the spindle 222 is also disposed through a hollow space defined by the shock absorber body 224.

In the view illustrated in FIG. 19, the viscosity adjustment screw 324 is fully screwed into the tube cap piston 322. This enables the tube cap piston 322 to be fully disposed against a viscosity adjustment wall 1902 located within the tube cap. When the tube cap piston 322 is fully disposed against the viscosity adjustment wall 1902 as shown in FIG. 19 (because the viscosity adjustment screw 324 is not creating additional space between a face of the tube cap piston 322 and a face of the viscosity adjustment wall 1902), then the viscosity permitted to flow through the tube cap assembly 206 portion is maximized. As shown in FIG. 19, the placement of the tube cap piston 322 against the viscosity adjustment wall 1902 maximizes the openings of the tube cap ports 228.

Figure 20:
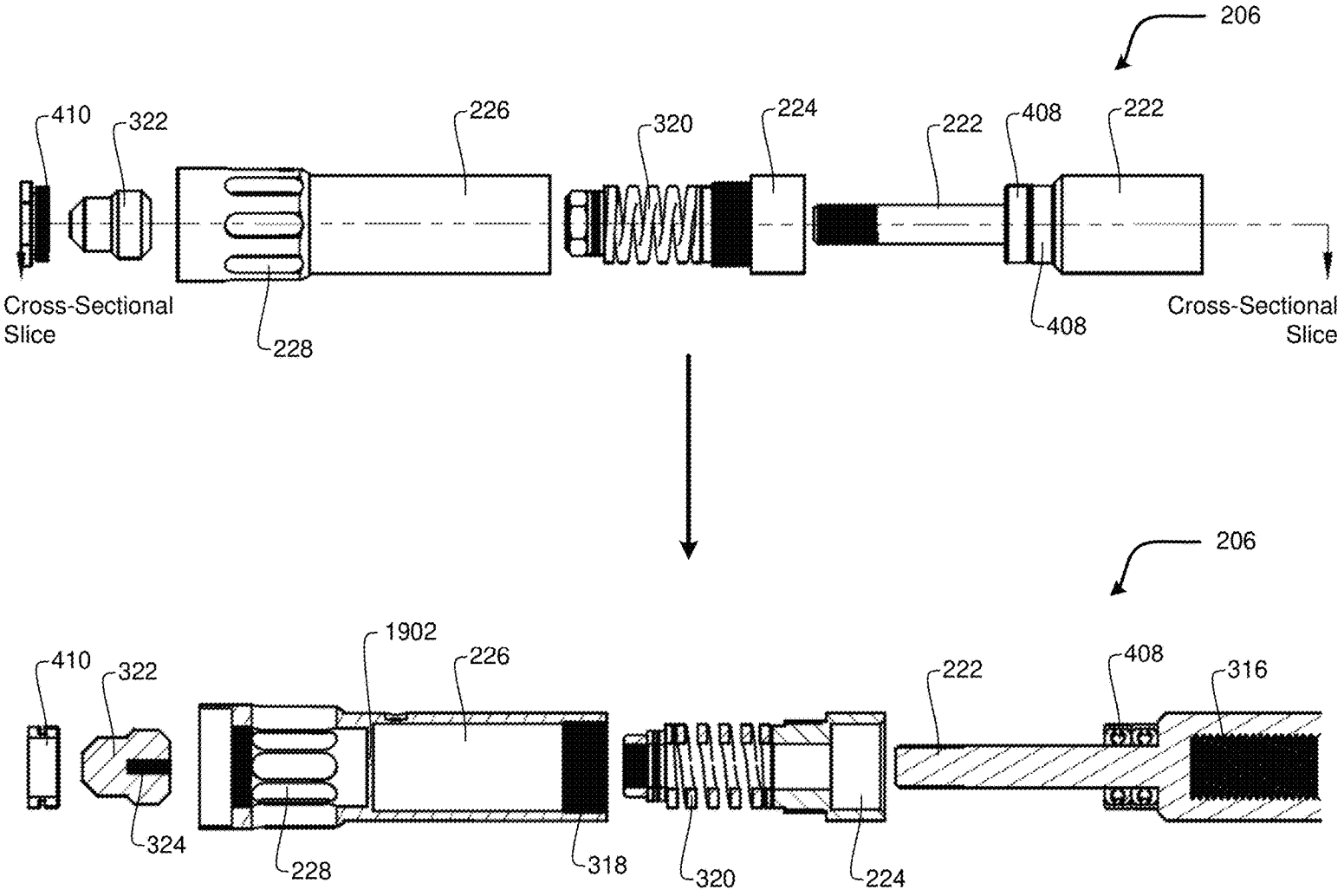
FIG. 20 is a cross-sectional and exploded straight-on side view of component of a tube cap assembly portion of an assembly for performing a drilling operation.

FIG. 20 is a cross-sectional and exploded straight-on side view of components of the tube cap assembly 206 portion of the head assembly 200. The tube cap assembly 206 includes several components located at a downhole end of the head assembly 200. The tube cap assembly 206 specifically includes at least the tube cap 226, tube cap piston 322, viscosity adjustment screw 324, and terminating tube cap 410. The tube cap assembly 206 further includes a viscosity adjustment wall 1902 located within the tube cap 226, and specifically located downhole relative to the tube cap ports 228 of the tube cap 226. The viscosity adjustment wall 1902 is a fluid-tight surface formed in an interior space defined by the tube cap 226.

The uphole end of the viscosity adjustment screw 324 abuts against the viscosity adjustment wall 1902. Thus, when the viscosity adjustment screw 324 is only partially screwed into the tube cap piston 322, then the maximum fluid viscosity permitted to pass around the tube cap piston 322 and through the tube cap ports 228 will be decreased. Likewise, when the viscosity adjustment screw 324 is further screwed into the tube cap piston 322, and the tube cap piston 322 is thereby abutted directly against the viscosity adjustment wall 1902, then the maximum fluid viscosity permitted to pass around the tube cap piston 322 and through the tube cap ports 228 will be maximized. The viscosity adjustment screw 324 is utilized to accommodate for changes in viscosity when the viscosity of the drill fluid is raised to slow down the movement of fluid, or when the viscosity of the drill fluid is lowered to increase the movement of fluid. Thus, viscous fluids will pass through the bodies more efficiently when the viscosity adjustment screw 324 is utilized to create a wider opening.

Figure 21A:
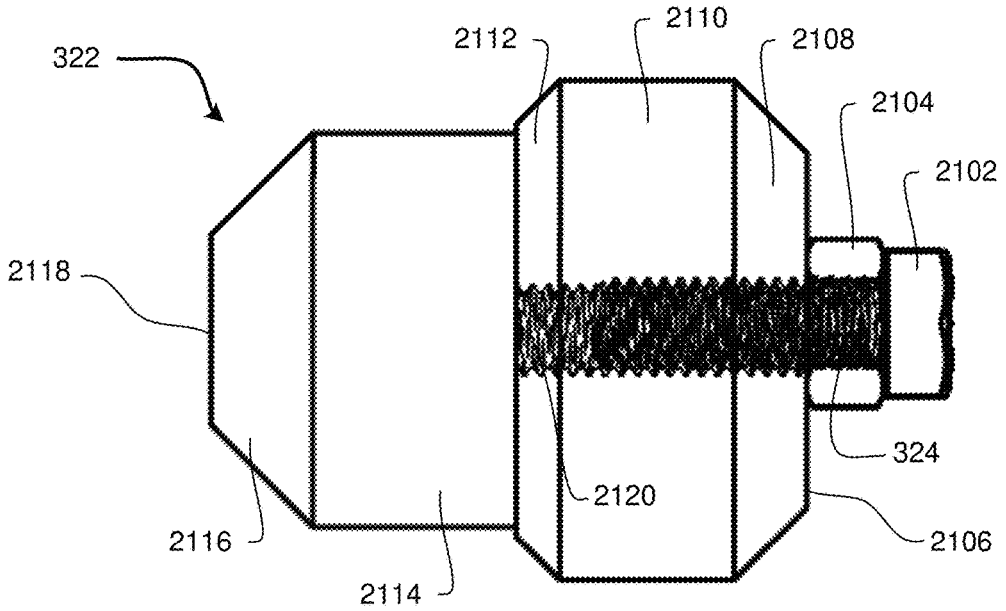
FIG. 21A is a schematic illustration of a tube cap piston and viscosity adjustment screw, wherein the viscosity adjustment screw is substantially fully screwed into the tube cap piston.
Figure 21B:
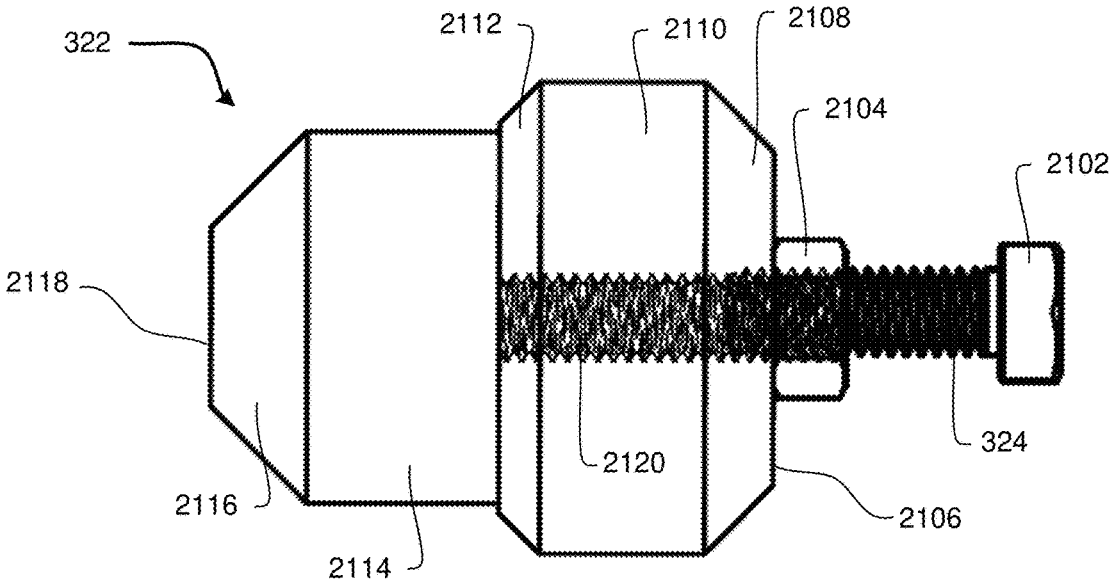
FIG. 21B is a schematic illustration of a tube cap piston and viscosity adjustment screw, wherein the viscosity adjustment screw is only partially screwed into the tube cap piston.

FIGS. 21A and 21B are schematic illustrations of the tube cap piston 322 and viscosity adjustment screw 324 of the tube cap assembly 206 portion of the head assembly 200. FIG. 21A illustrates wherein the viscosity adjustment screw 324 is substantially fully screwed into the tube cap piston 322, and thus, the maximum fluid viscosity permitted to flow through the tube cap assembly 206 is maximized. FIG. 21B illustrates wherein the viscosity adjustment screw 324 is only partially screwed into the tube cap piston 322, and thus, the maximum fluid viscosity permitted to flow through the tube cap assembly 206 is decreased relative to the configuration illustrated in FIG. 21A.

The tube cap piston 322 includes a larger diameter body 2110 and a smaller diameter body 2114, wherein the smaller diameter body 2114 comprises a shorter diameter when compared with the larger diameter body 2110. As shown in FIGS. 21A-21B, the larger diameter body 2110 is located uphole relative to the smaller diameter body 2114. The tube cap piston 322 additionally includes a larger diameter face 2106 that is located uphole relative to a smaller diameter face 2118. As shown, the viscosity adjustment screw 324 is screwed into the tube cap piston 322 at the larger diameter face 324. The tube cap piston 322 includes a chamfered edge 2116 disposed between the smaller diameter face 2118 and the smaller diameter body 2114. Additionally, the tube cap piston 322 includes a chamfered edge 2112 disposed in between the smaller diameter body 2114 and the larger diameter body 2110. Additionally, the tube cap piston 322 includes a chamfered edge 2108 disposed between the larger diameter body 2110 and the larger diameter face 2106.

The viscosity adjustment screw includes a shaft portion (i.e., the portion screwed into the tube cap piston 322), and further includes a head 2102 portion. The system may additionally include a washer 2104 or spacer disposed in between the larger diameter face 2106 of the tube cap piston 322, and the head 2102 of the viscosity adjustment screw 324. As shown in FIGS. 21A-21B, the tube cap piston 322 includes a threaded blind recess 2120 configured to receive the viscosity adjustment screw 324.

The tube cap piston 322 includes the viscosity adjustment screw 324 that protrudes from the larger diameter face 2106 (i.e., the uphole face) of the tube cap piston 322. The viscosity adjustment screw is threaded into the tube cap piston 322. The viscosity adjustment screw 324 has a threaded body that fits within the threaded blind recess 2120 in the tube cap piston 322. The head 2102 portion of the viscosity adjustment screw 324 engages with the viscosity adjustment wall 1902 of the tube cap 226. An operator may rotate the viscosity adjustment screw 324 and thereby cause the tube cap piston 322 to move in an uphole or downhole direction relative to the viscosity adjustment wall 1902 of the tube cap 226. This thereby adjusts the size of the fluid passageway through the tube cap 226. A larger passageway is better suited for fluids with high viscosity, and a smaller passageway is better suited for fluids with low viscosity.

The tube cap piston 322 fits within the tube cap 226 and selectively blocks the tube cap ports 228. Controlling the position and movement of the tube cap piston 322 allows the operator to control the fluid flow through the tube cap assembly 206 portion of the head assembly 200. When the viscosity adjustment screw 324 is fully screwed into the threaded blind recess 2120 of the tube cap piston 322, as shown in FIG. 21A, or when the viscosity adjustment screw 324 is removed altogether, then then tube cap piston 322 will be located nearest the viscosity adjustment wall 1902, and the maximum fluid viscosity permitted to flow through the tube cap 226 will be maximized. By contrast, when the viscosity adjustment screw is only partially screwed into the threaded blind recess 2120 of the tube cap piston 322, as shown in FIG. 21B, then the maximum fluid viscosity permitted to flow through the tube cap 226 will be decreased.

The tube cap piston 322 is a generally cylindrical member having a uniform cross-sectional shape. In some implementations, the tube cap piston 322 has a round outer profile. However, in other implementations, the tube cap 226 or the terminating tube cap 410 are configured with a non-round shape, such as a hexagonal geometry or other polygonal geometry. This may be implemented to prevent the tube cap piston 322 from rotating relative to the tube cap 226 or the terminating tube cap 410.

The head assembly 200 of the disclosure can be implemented in a core drilling operation according to the following procedures. There are three stages for the head assembly: descent, operation, and ascent. Beginning with the descent, the expansion block latch assembly 202 portion of the head assembly 200 is oriented in a descending position, with the expansion block 304 located toward the uphole end of the head assembly 200. This causes the latch ears 214 to retract radially relative to the cylindrical body of the upper body 208.

In the operation stage, an operator may pump fluid down to the head assembly 200 to urge the valve ball 406 in the downhole direction until the valve ball 406 passes through the valve bushing 404. When the valve ball 406 passes through the valve bushing 404, additional fluid will be permitted to flow through the upper body 208 and into the lower body 218.

In the ascent stage, the retractor case 302 is pulled upward, which also pulls the expansion block 304 upward, and causes the latch ears 214 to retract. This facilitates releasing the head assembly 200 from a tube surrounding the head assembly 200, and this thereby decreases wear on the latch ears 214 during ascent.

Figure 22:
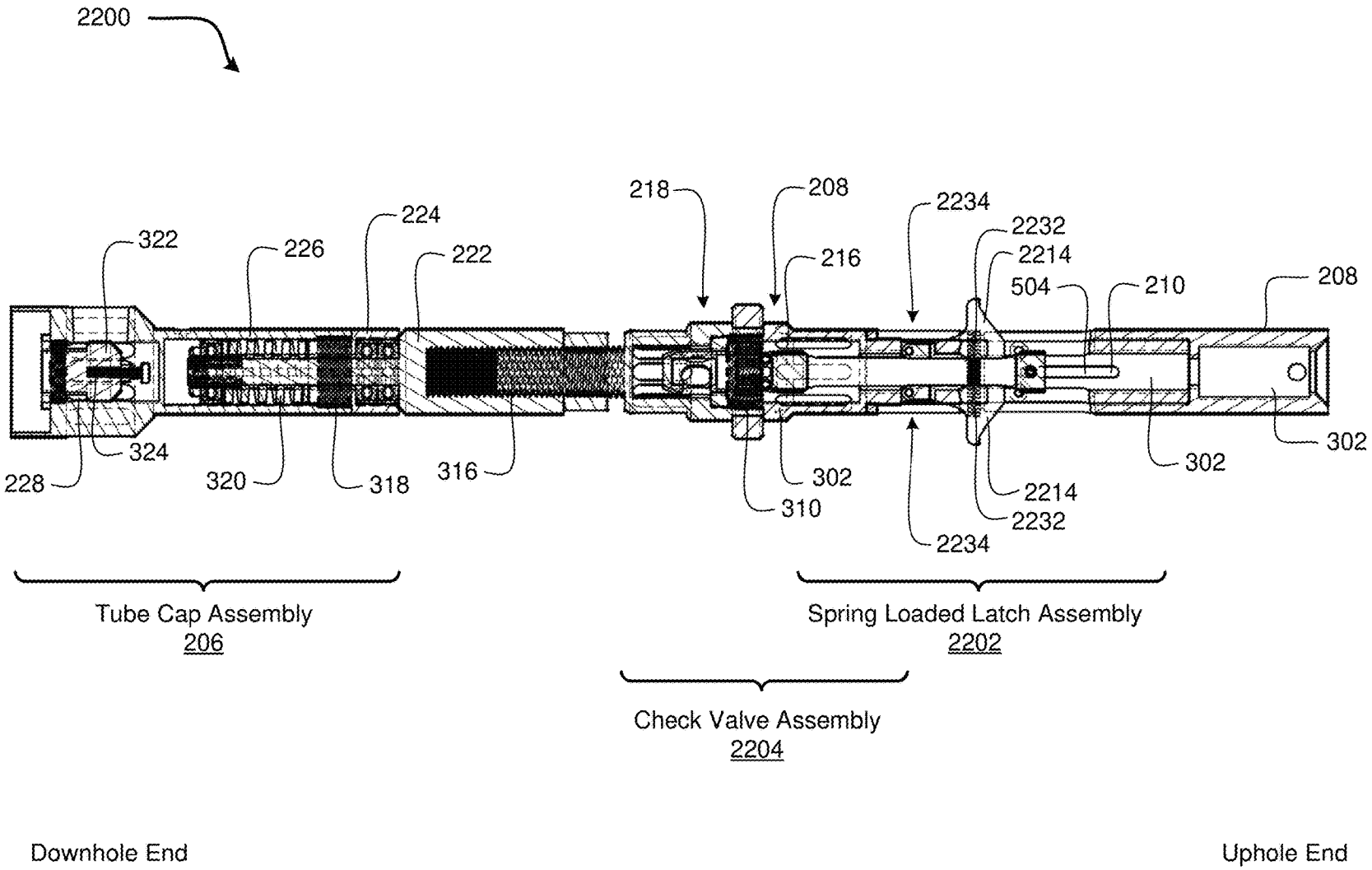
FIG. 22 is a cross-sectional and wireframe side view of an assembly for performing a drilling operation, wherein the assembly includes a spring loaded latch assembly.

FIG. 22 is a wireframe straight-on side view of a head assembly 2200 for performing a drilling operation. The head assembly 2200 includes similar features to the head assembly 200 that is first described in connection with FIGS. 2A and 2B. Namely, the head assembly 2200 includes components of the tube cap assembly 206 as they are described herein, including as they are described at least in connection with FIGS. 2A-2B, 3A-3B, 4, 6A-6B, 19-20, and 21A-21B.

The head assembly 2200 differs from the head assembly 200 (see head assembly 200 first described in connection with FIGS. 2A-2B) because the head assembly 2200 includes a spring loaded latch assembly 2202, rather than the expansion block latch assembly 202. The spring loaded latch assembly 2202 includes components for holding latch ears within a retracted position to prevent the latch ears from prematurely extending as the head assembly 2200 descends down a core barrel.

The head assembly 2200 further differs from the head assembly 200 (see head assembly 200 first described in connection with FIGS. 2A-2B) because the head assembly 2200 includes a check valve assembly 2204 that differs slightly from the check valve assembly 204 (see check valve assembly 204 first described in connection with FIGS.

2A-2B). The check valve assembly 2204 includes many components like the check valve assembly 204, but unlike the check valve assembly 204 that interfaces directly with the expansion block latch assembly 202, the check valve assembly 2204 does not interface directly with the spring loaded latch assembly 2202.

As described herein, the head assembly 2200 includes an "uphole end" that is located nearest the surface of a substrate during a drilling operation, and further includes a "downhole end" that is located deeper in the substrate relative to the uphole end. The spring loaded latch assembly 2202 is located at the uphole end of the head assembly 2200, and the tube cap assembly 206 is located at the downhole end of the head assembly 2200.

The head assembly 2200 includes an upper body 208 that comprises a cylindrical geometry. The upper body 208 includes a body pin slot 210, which comprises an elongated hole formed in the sidewall of the cylindrical upper body 208. The upper body 208 encases components of the spring loaded latch assembly 2202.

The head assembly 2200 includes a retractor case 302 comprising a sidewall that defines a hollow interior. The retractor case 302 includes a retractor pin slot 504, which comprises an elongated hole formed in the sidewall of the retractor case 302. The retractor case 302 is configured to be disposed within the upper body 208. When the retractor case 302 is fully retracted into the upper body 208, the retractor pin slot 504 aligns with the body pin slot 210 as shown in FIG. 22.

The head assembly 2200 includes at least one latch ear 2214 as a component of the spring loaded latch assembly 2202. As shown in FIG. 22, the head assembly 2200 may include two latch ears 2214 that are diametrically opposed to one another relative to the cylindrical geometry of the upper body 208. At least a portion of each latch ear 2214 is disposed within a hollow inner space defined by the sidewall of the upper body 208. The portion of the latch ear 2214 that is visible in FIG. 22 is configured to interface with the inner wall of a concentric tube surrounding the head assembly 2200.

The check valve assembly 2204 is formed where a downhole end of the upper body 208 interfaces with an uphole end of a lower body 218 of the head assembly 2200. The check valve assembly 2204 includes components for creating a valve that reacts to an external force to permit or block the flow of fluid. The upper body 208 includes an upper body fluid port 216 that permits fluid to flow into and out of an interior space defined by a sidewall of the upper body 208. The lower body 218 includes a lower body fluid port 220 that permits fluid to flow into and out of an interior space defined by a sidewall of the lower body 218.

The head assembly 2200 further includes a spindle 222, a shock absorber body 224, and a tube cap 226. The spindle 222 includes a shaft for receiving bearings to be attached to the head assembly 2200 as a replaceable wear item. Additionally, the spindle 222 serves as a shock absorber when the latch assembly portion 202 is stopped at a landing ring located within a core barrel. The stopping forces are transferred to the head assembly 2200 and then absorbed by a shock absorption spring disposed around the spindle 222.

The tube cap includes a tube cap port 228 that permits fluid to flow into and out of an interior space defined by a sidewall of the tube cap 226. The spindle 222 is a shock-absorbing component that prevents or mitigates damage to the head assembly 2200 caused when the components of the drilling operation contact one another, such as when the head assembly 2200 is lowered into the well and reaches the core barrel, or when an overshot is lowered to the head assembly 2200 and strikes the retractor case.

Referring now to the spring loaded latch assembly 2202 first illustrated in FIG. 22, the head assembly 2200 includes the latch ears 2214 that are pivotably connected to the upper body 208 and positioned within a latch ear opening (not shown) that is disposed through the sidewall of the upper body 208. The latch ears 2214 are selectively pivoted to expand or retract away from or toward the cylindrical geometry of the upper body 208. The distraction and retraction of the latch ears 2214 prevents or at least mitigates wear on the latch ears 2214, and further facilitates releasing the latch ears 2214 such that the head assembly 2200 may be pulled up from the drilling hole. Conventional designs of head assemblies comprising a latching mechanism do not have the ability to retract the latching mechanism. This results in the traditional head assemblies experiencing excessive wear when the latching mechanisms drag along an interior surface of the tube when the head assembly is removed from the tube.

The spring loaded latch assembly 2202 differs from the expansion block latch assembly 202 at least because the spring loaded latch assembly 2202 includes a latch spring 2232 that provides pressure causing the latch ears 2214 to extend outward relative to the sidewall of the upper body 208. The mechanical equilibrium of the latch spring 2232 may cause each of the latch ears 2214 to extend at least partially outward relative to the body sidewall. The latch spring 2232 provides sufficient pressure to naturally cause the latch ears 2214 to swing outward but to also permit the latch ears 2214 to be pushed into the interior space defined by the upper body 208 as needed. The compressive force of the latch spring 2232 is selected such that even minor pressure, including the pressure of the latch ears 2214 against an interior surface of a tube when the head assembly 2200 is utilized during a drilling operation, can cause the latch ears 2214 to swing inward toward the center of the body.

Each of the latch ears 2214 includes a pivot point 2234 wherein the latch ear 2214 may freely rotate. Each pivot point 2234 includes a first body pivot hole and a second body pivot hole disposed through the body sidewall. Each pivot point 2234 additionally includes a latch pivot hole disposed through a body of a latch ear 2214. The latch pivot hole is aligned with each of the first body pivot hole and the second body pivot hole, and a latch ear pin is then disposed through each of the first body pivot hole, the second body pivot hole, and the latch pivot hole. The latch ear pin enables the latch ears 2214 to rotate about the pivot point 2234. Thus, the latch ear 2214 may rotate in toward the interior space defined by the upper body 208, or the latch ear 2214 may rotate out to extend outward relative to the sidewall defining the upper body 208.

Figure 23:
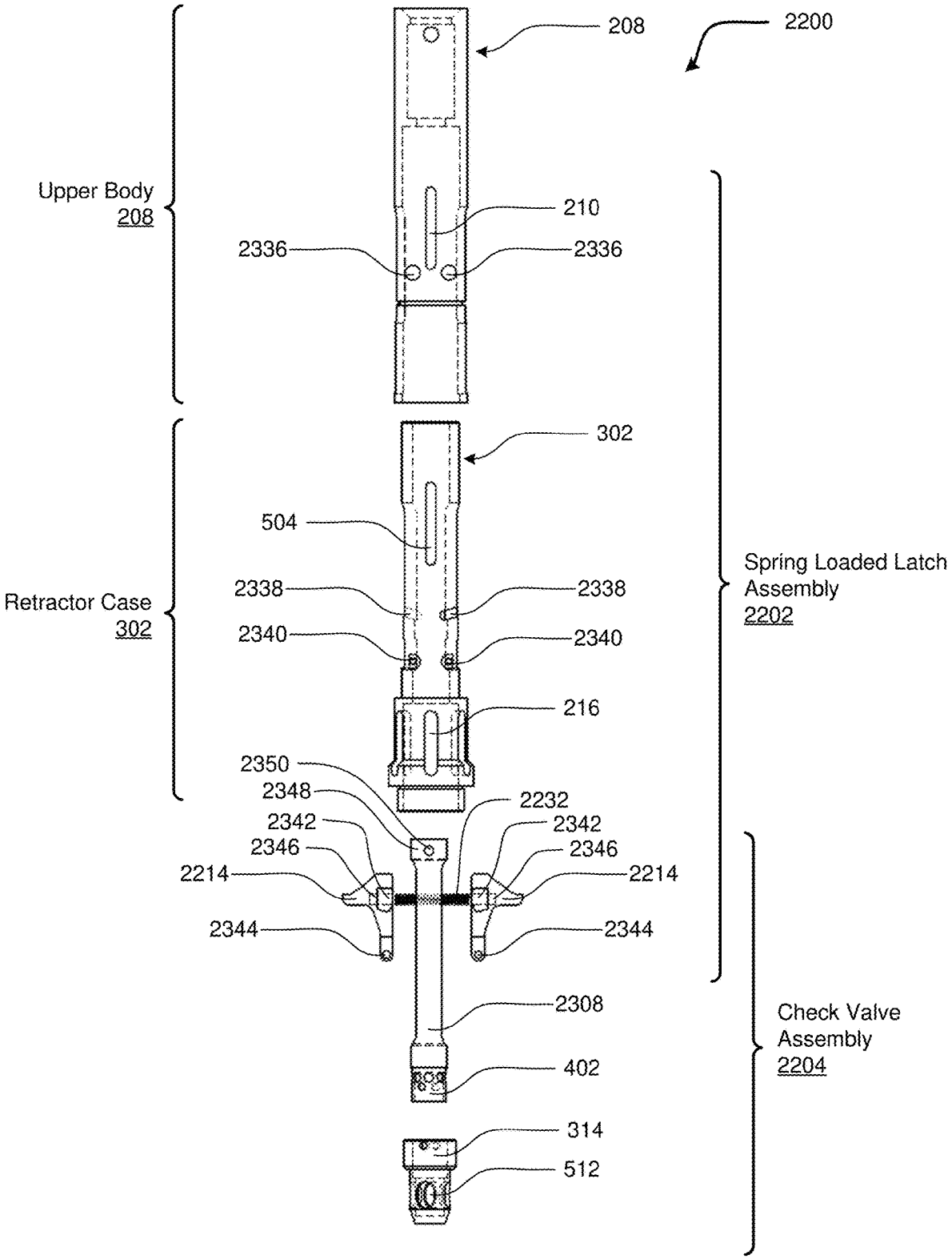
FIG. 23 is an exploded side view of a portion of an assembly for performing a drilling operation, wherein the assembly includes a spring loaded latch assembly.

FIG. 23 is an exploded straight-on side view of component of the head assembly 2200, and specifically illustrates components of the spring loaded latch assembly 2204 and the check valve assembly 2204.

The upper body 208 includes a sidewall defining a hollow interior configured to receive the retractor case 302. The exploded view in FIG. 23 includes dotted lines within the upper body 208 to illustrate the hollow portion configured to receive the retractor case 302. The retractor case 302 includes a sidewall defining a hollow interior configured to receive components of the check valve assembly 2204, including at least a piston shaft 2308 of the check valve assembly 2204. The exploded view in FIG. 23 includes dotted lines within the retractor case 302 to illustrate the hollow portion configured to receive other components of the had assembly 2200.

The upper body 208 includes the body pin slot 210 formed in the sidewall of the upper body 208. The retractor case 302 includes the retractor pin slot 504 formed in the sidewall of the retractor case 302. When the retractor case 302 is fully disposed within the upper body 208, the body pin slot 210 of the upper body 210 will align with the retractor pin slot 504 of the retractor case 302.

The upper body 208 includes a failsafe assembly 2336 configured to prevent a piston shaft 2308 from falling further downhole when the head assembly 2200 is in use. The failsafe assembly 2336 includes a hole formed in the sidewall of the upper body 208 as shown in FIG. 23. The failsafe assembly 2336 may additionally include a pin disposed through the hole, wherein the pin prevents the piston shaft 2308 from sliding uphole beyond the failsafe assembly 2336.

The retractor case 302 includes a retractor pivot hole 2340 formed in the sidewall of the retractor case 302. The retractor case 302 may include two retractor pivot holes 2340 for each latch ear 2214. Thus, if the head assembly 2200 includes two latch ears 2214, then the retractor case 302 may include four retractor pivot holes 2340. The retractor pivot holes 2340 may be arranged such that a pin may be disposed through a first retractor pivot hole 2340, through an interior of the retractor case 302, and then out through a second retractor pivot hole 2340.

The retractor case 302 includes a latch holding slot 2338 formed in the sidewall of the retractor case 302. The latch holding slot 2338 is a cutout formed in the sidewall of the retractor case 302 that is configured to receive a portion of a latch ear 2214 when the latch ear 2214 is in the retracted position.

The spring loaded latch assembly 2202 includes the latch ears 2214 and the latch spring 2232 disposed in between the latch ears 2214. Each latch ear 2214 includes a spring hole 2346 formed within the body of the latch ear 2214, and the spring hole 2346 is configured to receive the latch spring 2232. Each of the latch ears 2214 additionally includes a latch lock 2342, which includes a lug extending outward relative to the body of the latch ear 2214. The latch lock 2342 comprises a width that is greater than the width of the body of the latch ear 2214. The latch lock 2342 prevents the latch ear 2214 from sliding upward through the upper body 208 in the event that a pin within the pivot point 2234 fails.

Each latch ear 2214 includes a latch pivot hole 2344 disposed through the body of the latch ear 2214. The latch pivot hole 2344 is configured to align with the retractor pivot hole 2340. The pivot point 2234 of the spring loaded latch assembly 2202 includes a pin disposed through each of a latch pivot hole 2344, a first retractor pivot hole 2340, and a second retractor pivot hole 2340, that are all in alignment with one another. The pivot point 2234 enables the latch ear 2214 to rotate in toward an interior of the retractor case 302, and out away from the retractor case 302. The mechanical equilibrium of the latch spring 2232 may cause the latch ears 2214 to be disposed in an extended position as shown in FIG. 22. When the head assembly 2200 is disposed within a tube to perform a drilling operation, the interior wall of the tube may press against the latch ears 2214 and cause the latch ears 2214 to rotate inward.

The check valve assembly 2204 includes the piston shaft 2308. Similar to the piston shaft 308 described in connection with the check valve assembly 204 (see at least FIGS. 2A-2B, 3A-3B, 4-5, 6A-6B, 9A-9B, 13-17, and 18A-18B), the piston shaft 2308 also includes a fluid retention cage 402 attached to a downhole end of the piston shaft 2308. The fluid retention cage 402 is configured to interface with a retention piston 314 that comprises a plurality of check valve ports 512.

The piston shaft 2308 additionally includes a shaft flange 2348 located at an uphole end of the piston shaft 2308. The shaft flange 2348 may include a pin slot interface 2350 protruding outward relative to the shaft flange 2348. The pin slot interface 2350 is configured to be disposed through the retractor pin slot 504 of the retractor case 302. The retractor case 302 slides upward and downward during installation and usage of the head assembly 2200, and the pin slot interface 2350 serves to constrain the movement of the retractor case 302 and ensure a coupling between the retractor case 302 and the piston shaft 2308.

The piston shaft 2308 differs from the piston shaft 308 (see at least FIGS. 2A-2B, 3A-3B, 4-5, 6A-6B, 9A-9B, 13-17, and 18A-18B) because the piston shaft 2308 is not coupled to an expansion block. The piston shaft 2308 does not directly interact with the spring loaded latch assembly 2202, and the position of the piston shaft 2308 does not alter the rotational position of the latch ears 2214. However, the piston shaft 2308 otherwise functions like the piston shaft 308, and the check valve assembly 2204 otherwise functions like the check valve assembly 204. For example, the check valve assembly 2204 includes the same valve components as described at least in connection with FIGS. 16-17 and 18A-18B.

Figure 24:
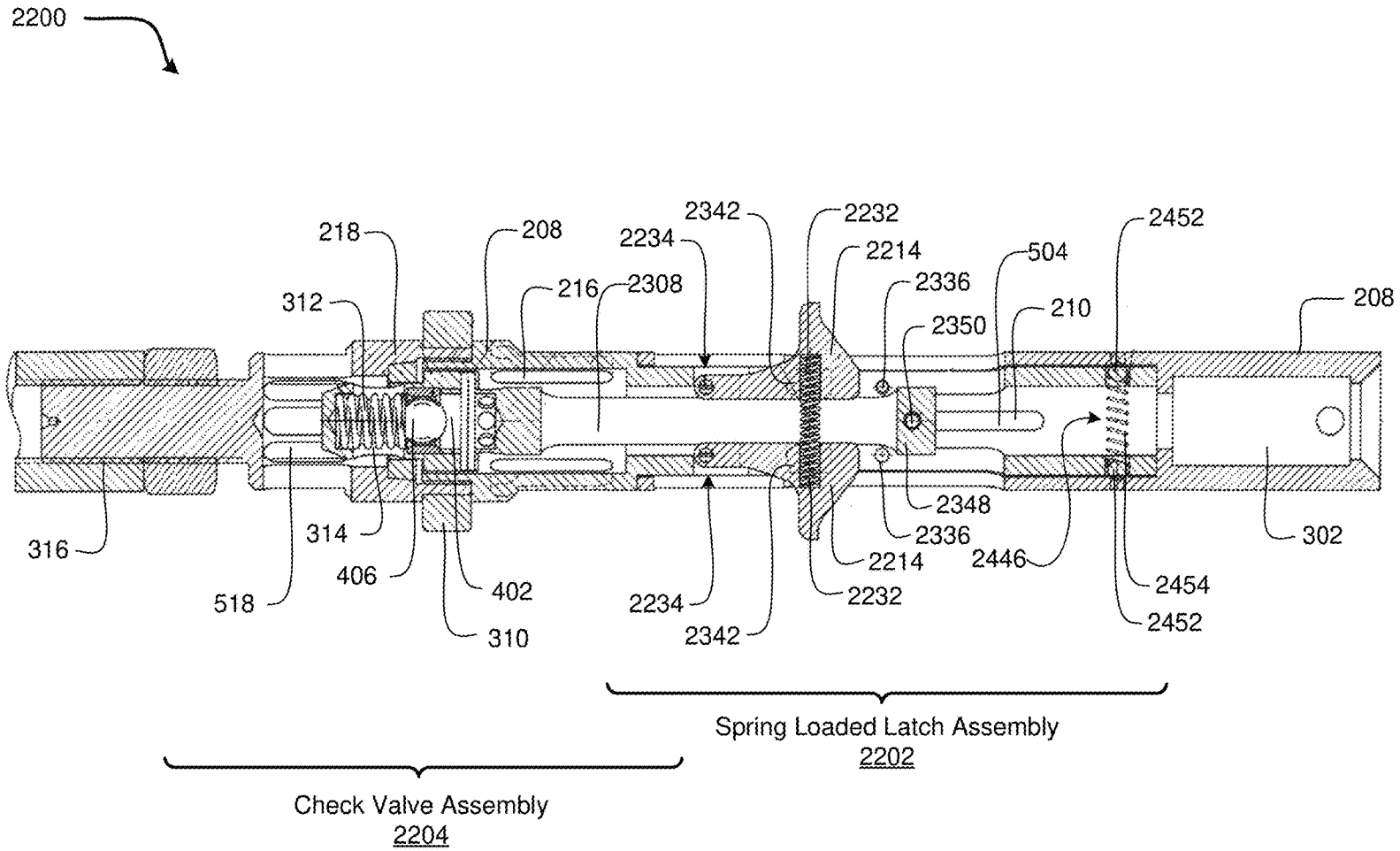
FIG. 24 is a cross-sectional side view of a portion of an assembly for performing a drilling operation, wherein the assembly includes a spring loaded latch assembly.

FIG. 24 is a cross-sectional straight-on side view of a portion of the head assembly 2200 for performing a drilling operation, and specifically illustrates components of the spring loaded latch assembly 2202 and the check valve assembly 2204. FIG. 24 illustrates wherein the retractor case 302 is slip toward the uphole end of the upper body such that the retractor pin slot 504 is aligned with the body pin slot 210. FIG. 24 further illustrates wherein the spring loaded latch assembly is in the extended (distracted) position.

The spring loaded latch assembly 2202 may include a spring detent 2446 to hold the latch ears 2214 in a retracted position. The spring detent 2446 may be particularly useful when the head assembly 2200 is being installed within a core barrel to perform a drilling operation. The spring detent 2446 holds the latch ears 2214 in the retracted to position to prevent the latch ears 2214 from scraping against the interior wall of the core barrel and wearing out during descent. The spring detent 2446 may additionally aid during cold weather to ensure the latch ears 2214 do not freeze in an extended (distracted) position.

The spring detent 2446 holds the latch ears 2214 in the retracted position when the retractor case 302 is pulled upward. The spring detent 2446 may include two or more detent balls 2452 and a compression spring 2454. The two or more detent balls 2452 push against the retractor case 302, which causes the retractor case 302 to slide upward, and further causes the latch ears 2214 to lock into the retracted position. When the head assembly 2200 hits a core barrel, the retractor case 302 releases the two or more detent balls 2452 and slides downward along the body pin slot 210.

The head assembly 2200 is designed such that there is no interaction between the piston shaft 2308 of the check valve assembly 2204 and the latch ears 2214 of the spring loaded latch assembly 2202. The piston shaft 2308 moves with fluid pressure within the upper body 208 of the head assembly 2200. When the piston shaft 2308 is pulled upward, this allows for fluid pressure to equalize between the upper body 208 and an outer core barrel, such that the fluid is released into the upper body 208 and the outer core barrel. The hydrostatic water pressure may be released and equalized to permit easier extraction of the head assembly 2200 from the outer core barrel.

When the head assembly 2200 is descending into the outer core barrel, there is fluid passing through the head assembly 2200. This may cause the retention piston 314 and the piston shaft 2308 to both move into an uphole-most position within the chamber. The position of the retention piston 314 and the piston shaft 2308 will be constrained by the position of the pin slot interface 2350 within the retractor pin slot 504 and the body pin slot 210. When the head assembly 2200 concludes its descent and reaches the bottom of the outer core barrel, the retention piston 314 and piston shaft 2308 drop down and hit the bushing within the lower body. The pin slot interface 2350 of the piston shaft 2308 will then drop into the downhole-most position within the retractor pin slot 504 and body pin slot 210.

Figure 25:
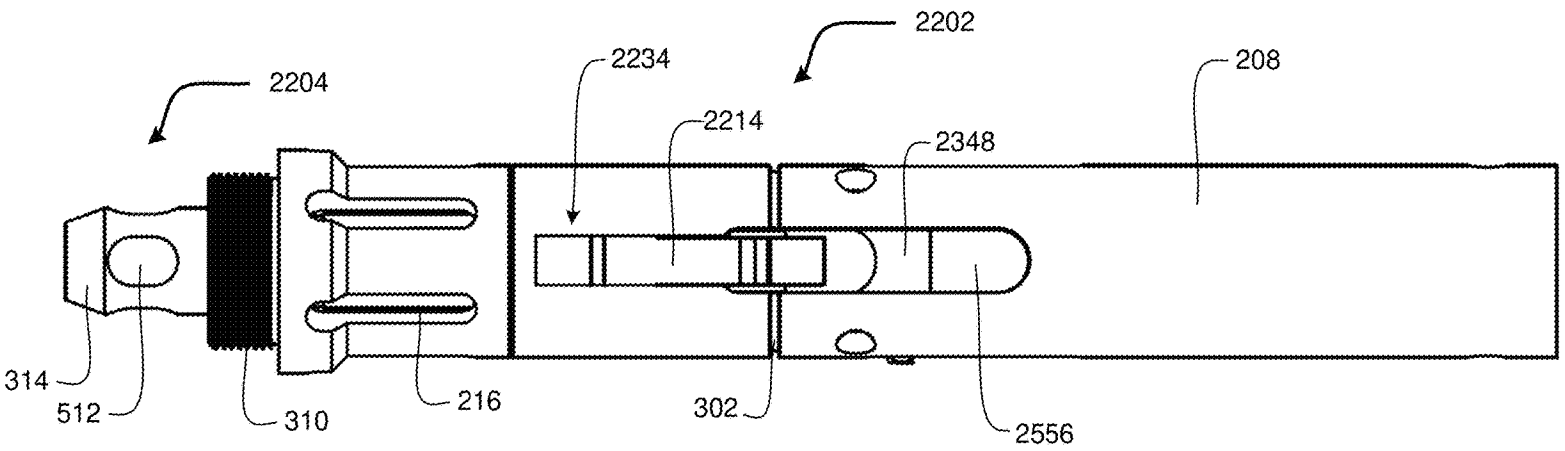
FIG. 25 is a side view of a portion of an assembly for performing a drilling operation, wherein the assembly includes a spring loaded latch assembly.

FIG. 25 is a straight-on side view of a portion of the head assembly 2200 for performing a drilling operation, and specifically illustrates some components of the spring loaded latch assembly 2202 and the check valve assembly 2204. FIG. 25 illustrates wherein the head assembly 2200 has been rotated 90 degrees relative to the views shown in at least FIGS. 22-24 and 26. FIG. 25 thus illustrates wherein the latch ear 2214 is extending out of the page.

The upper body 208 includes a latch ear hole 2556 cut into the sidewall of the upper body 208. The upper body 208 may specifically include two latch ear holes 2556 that are diametrically opposed to one another across the cylindrical geometry of the upper body 208. The latch ear holes 2556 are sized such that the latch ear 2214 may rotate about its pivot point 2234 into the retracted and extended orientations. The retractor case 302 may similarly include two latch ear holes (not visible in FIG. 25) each configured to enable a latch ear 2214 to rotate about its pivot point 2234. The latch ear holes of the retractor case 302 may match and align with the latch ear holes 2556 of the upper body 208.

Figure 26:
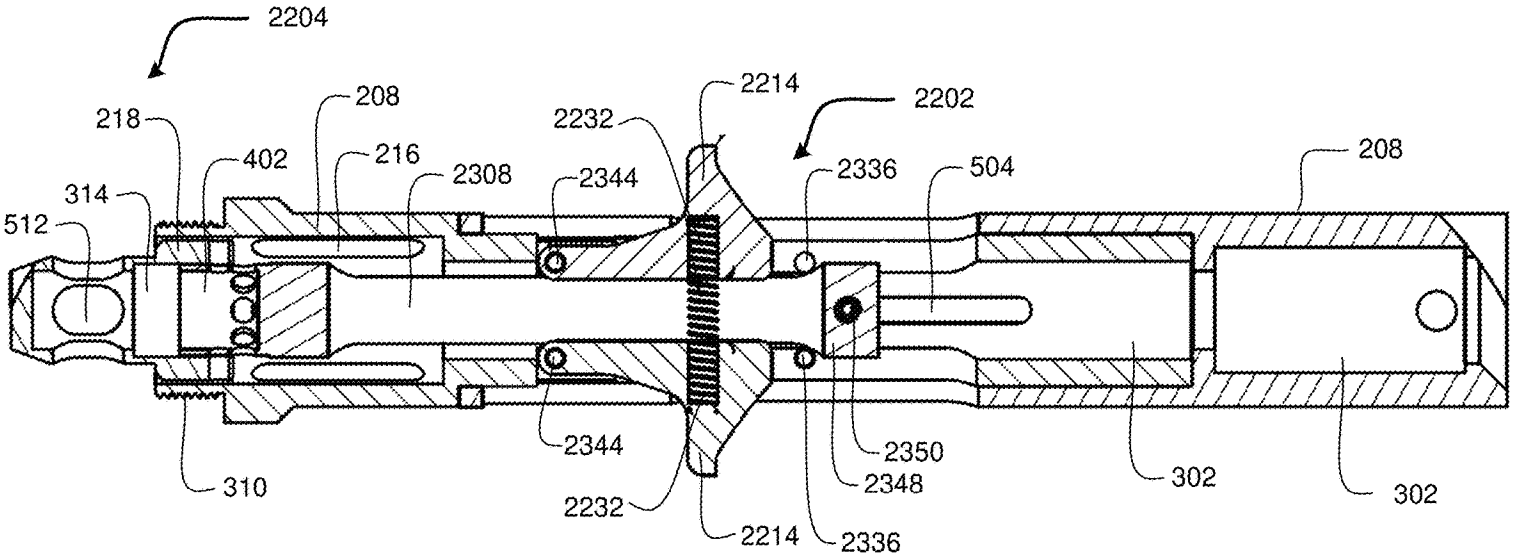
FIG. 26 is a cross-sectional side view of a portion of an assembly for performing a drilling operation, wherein the assembly includes a spring loaded latch assembly.

FIG. 26 is a cross-sectional straight-on side view of a portion of the head assembly 2200 for performing a drilling operation, and specifically illustrates some components of the spring loaded latch assembly 2202 and the check valve assembly 2204.

The cross-sectional view in FIG. 26 illustrates wherein the latch spring 2232 is in mechanical equilibrium and pushes the latch ears 2214 outward into the extended position. This may occur when the retractor case 302 is slid uphole such that the retractor pin slot 504 is aligned with the body pin slot 210 (not visible in the cross-sectional view of FIG. 26).

When the spring loaded latch assembly 2202 is in the extended (distracted, latched) orientation as shown in FIG. 26, an inner side of a latch arm (see 2904 at FIGS. 29A-29C) of the latch ears 2214 is aligned substantially parallel to a longitudinal axis of the piston shaft 2308. The head assembly 2200 may be arranged such that the inner side of the latch arm of the latch ears 2214 presses against the piston shaft 2308 when the latch ears 2214 are in the extended orientation.

When the latch ears 2214 are in the extended orientation as shown in FIG. 26, radial extensions (see 2906 at FIGS. 29A-29C) of the latch ears 2214 extend radially outward relative to the sidewall of the retractor case 302 and the sidewall of the upper body 208. A portion of the radial extensions is substantially perpendicular to the longitudinal axis of the head assembly 2200 when the latch ears 2214 are in the extended orientation.

Figure 27:
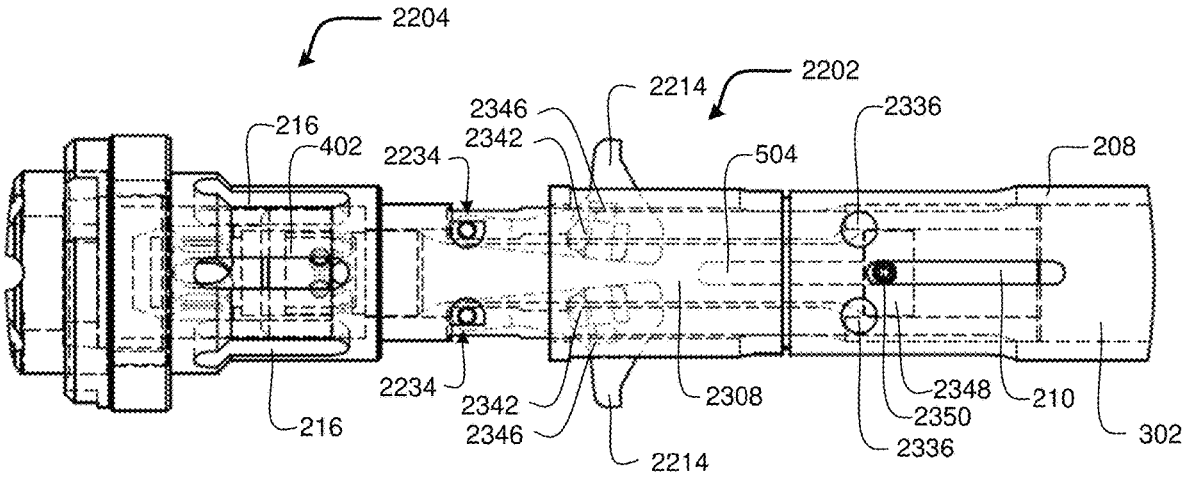
FIG. 27 is a cross-sectional side view of an assembly for performing a drilling operation, wherein the assembly includes a spring loaded latch assembly, and wherein the spring loaded latch assembly is in a retracted position.

FIG. 27 is a wireframe straight-on side view of a portion of the head assembly 2200 for performing a drilling operation, and specifically illustrates components of the spring loaded latch assembly 2202 and the check valve assembly 2204. FIG. 27 illustrates wherein the latch ears 2214 of the spring loaded latch assembly 2202 are in the retracted position. The spring loaded latch assembly 2202 may be in the retracted position as shown in FIG. 27 when the head assembly 2200 is being installed within a core barrel. The retracted position helps ensure the latch ears 2214 do not undergo excessive wear as the head assembly 2200 falls down the core barrel.

The wireframe view of FIG. 27 enables visualization into the positions of the retractor case 302 and the piston shaft 2308 when the spring loaded latch assembly 2202 is in the retracted position. As shown in FIG. 27, the retractor case 302 is located at its downhole-most position when the spring loaded latch assembly 2202 is in the retracted position. The retractor pin slot 504 is visible and not fully aligned with the body pin slot 210. Only an uphole-most portion of the retractor pin slot 504 is aligned with the downhole-most portion of the body pin slot 210. The pin slot interface 2350 of the piston shaft 2308 is disposed through each of the retractor pin slot 504 and the body pin slot 210. The pin slot interface 2350 prevents the retractor case 302 and the piston shaft 2308 from falling further downhole relative to the upper body 208.

When the downhole end of the retractor case 302 is pulled upward as shown in FIG. 27, the latch holding slot 2338 of the retractor case 302 interfaces with the latch lock 2342 of the latch ear 2214. The retractor case 302 thereby places inward pressure on the latch spring 2232 and causes the latch spring 2232 to compress. This permits the latch ears 2214 to rotate about the pivot point 2234 inward toward the hollow interior of the retractor case 302. The latch spring 2232 is compressed when the latch ears 2214 are in the retracted position as shown in FIG. 27, and thus, the latch spring 2232 will automatically cause the latch ears 2214 to rotate outward into the extended position (see at least FIG. 28) when the retractor case 302 no longer places inward pressure on the latch spring 2232.

Figure 28:
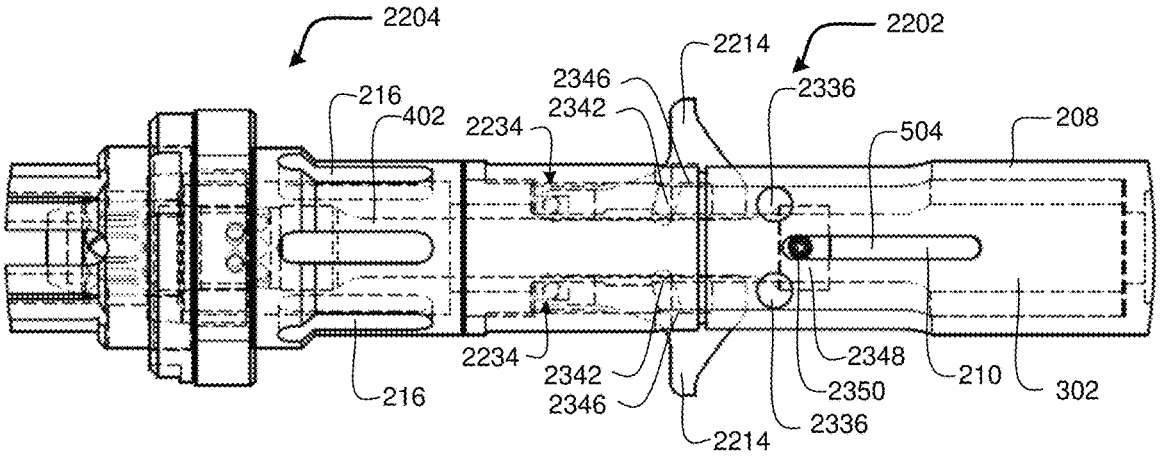
FIG. 28 is a cross-sectional side view of an assembly for performing a drilling operation, wherein the assembly includes a spring loaded latch assembly, and wherein the spring loaded latch assembly is in an extended position.

FIG. 28 is a wireframe straight-on side view of a portion of the head assembly 2200 for performing a drilling operation, and specifically illustrates components of the spring loaded latch assembly 2202 and the check valve assembly 2204. FIG. 28 illustrates wherein the latch ears 2214 of the spring loaded latch assembly 2202 are in the extended (distracted, latched) position. The spring loaded latch assembly 2202 may be in the extended position when the head assembly 2200 has been installed within a core barrel, and the head assembly 2200 is in use.

The wireframe view of FIG. 28 enables visualization into the positions of the retractor case 302 and the piston shaft 2308 when the spring loaded latch assembly 2202 is in the extended position. As shown in FIG. 28, the retractor case 302 is located at its uphole-most position when the spring loaded latch assembly 2202 is in the extended position. The retractor pin slot 504 is fully aligned with the body pin slot 210. The pin slot interface 2350 of the piston shaft 2308 is disposed through each of the retractor pin slot 504 and the body pin slot 210. The pin slot interface 2350 prevents the retractor case 302 from sliding further uphole.

Figure 29A:
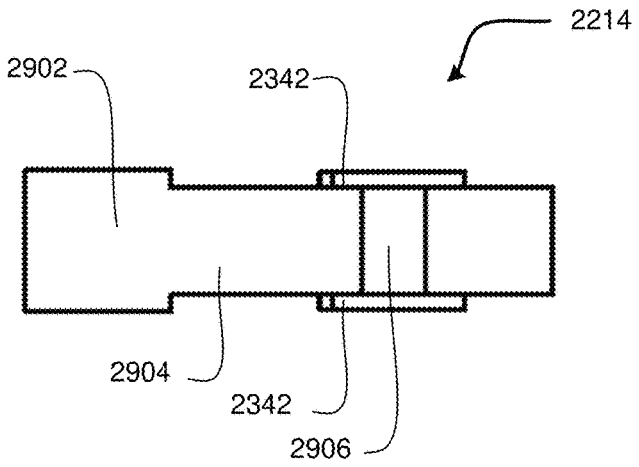
FIG. 29A is a straight-on view of an external side of a latch ear of a spring loaded latch assembly.
Figure 29B:
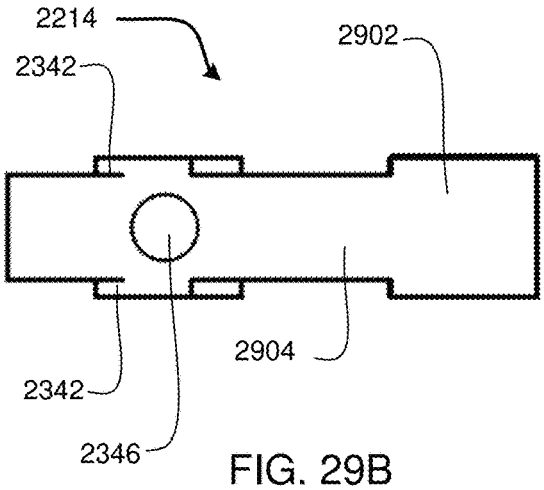
FIG. 29B is a straight-on view of an internal side of a latch ear of a spring loaded latch assembly.
Figure 29C:
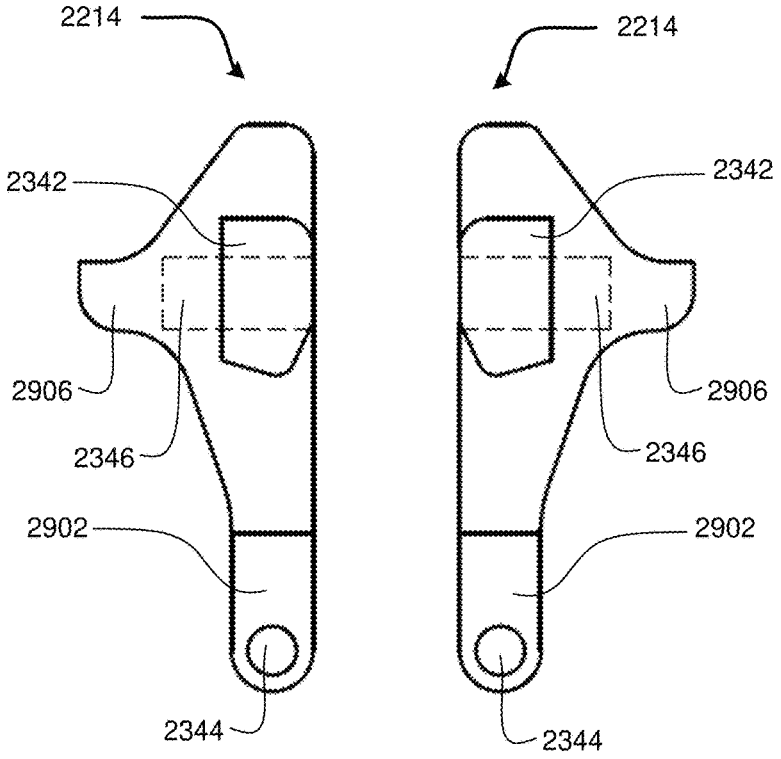
FIG. 29C is a straight-on side view of a pair of latch ears of a spring loaded latch assembly.

FIGS. 29A-29C illustrate various views of a latch ear 2214 of the spring loaded latch assembly 2202. FIG. 29A is straight-on side view of the latch ear 2214 and specifically illustrates the external side of the latch ear 2214 that points out toward an exterior of the head assembly 2200 when the latch ear 2214 is installed within the head assembly 2200. FIG. 29B is a straight-on side view of the latch ear 2214 and specifically illustrates an internal side of the latch ear 2214 that points inward toward an interior of the retractor case 302 when the latch ear 2214 is installed within the head assembly 2200. FIG. 29C is a straight-on side view of two latch ears 2214 located side-by-side in the orientation they would have when installed within the head assembly 2200.

The latch ear 2214 includes a pivot head 2902 attached to a latch arm 2904. The pivot head 2902 includes the latch pivot hole 2344 disposed therethrough, and the latch ear 2214 pivots about the latch pivot hole 2344. The latch arm 2904 is the portion of the latch ear 2214 that swings about the latch pivot hole 2344. The latch ear 2214 may include a latch radial extension 2906 attached to the latch arm 2904 and extending outward relative to a longitudinal axis of the latch arm 2904. The pivot head 2902 may include a width that is greater than a width of the latch arm 2904 or the latch radial extension 2906.

The latch ear 2214 includes the spring hole 2346 formed in the latch arm 2904 and latch radial extension 2906 portions of the latch ear 2214. The spring hole 2346 may include a blind hole that is cut only partially into the latch radial extension 2906. The spring hole 2346 is configured to receive the latch spring 2232 of the spring loaded latch assembly 2202. A pair of latch ears 2214 may be oriented parallel to one another as shown in FIG. 29C (i.e., in the extended position) when the latch spring 2232 is installed within the opposing spring holes 2346 and the latch spring 2232 is at its mechanical equilibrium.

The latch ear 2214 includes the latch lock 2342, which is a lug that extends outward relative to a surface of the latch arm 2904 and latch radial extension 2906 portions of the latch ear 2214. The latch lock 2342 extends outward sufficiently such that the latch ear 2214 is prevented from passing through the upper body 208. The latch lock 2342 thus serves as a fall restraint if a pivot pin disposed through the latch pivot hole 2344 breaks. The latch lock 2342 may extend outward relative to the latch arm 2904 by about 1.5 cm to about 2.5 cm in various implementations.

Figure 30:
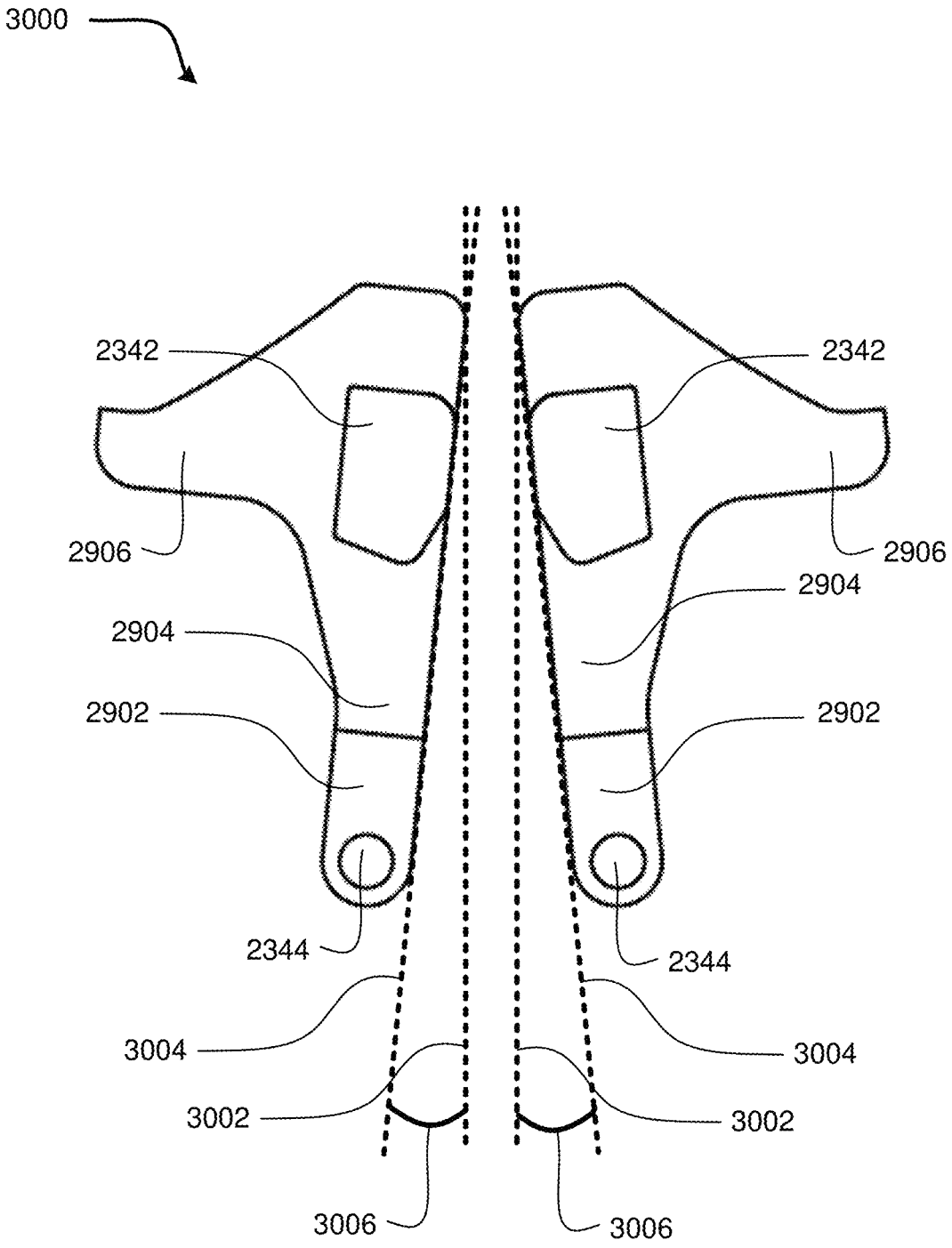
FIG. 30 is a straight-on side view of a retracted orientation of a pair of latch ears of a spring loaded latch assembly.

FIG. 30 is a straight-on side view of a retracted orientation 3000 for a pair of latch ears 2214 of the spring loaded latch assembly 2202. The latch ears 2214 are pivotably coupled to the retractor case 302, and the exterior surface of the retractor case 302 prevents the latch ears 2214 from fully retracting inward. The retraction angle may vary depending upon the implementation and specifically depending upon a thickness of the sidewall of the upper body 208.

The latch ears 2214 retract inward to form a retraction angle 3006. The retraction angle is defined by an angle formed in between a vertical axis 3002 and a pivot axis 3004. The vertical axis 3002 is parallel to a longitudinal axis of the head assembly 2200. The pivot axis 3004 runs along an inner side of the latch arm 2904 as shown in FIG. 30. The retraction angle 3006 may comprise from about 3 degrees to about 12 degrees; from about 4 degrees to about 10 degrees; from about 4 degrees to about 8 degrees; from about 5 degrees to about 7 degrees; or about 6 degrees. The retraction angle 3006 may vary depending upon a thickness of the sidewall of the upper body.

Figure 31:
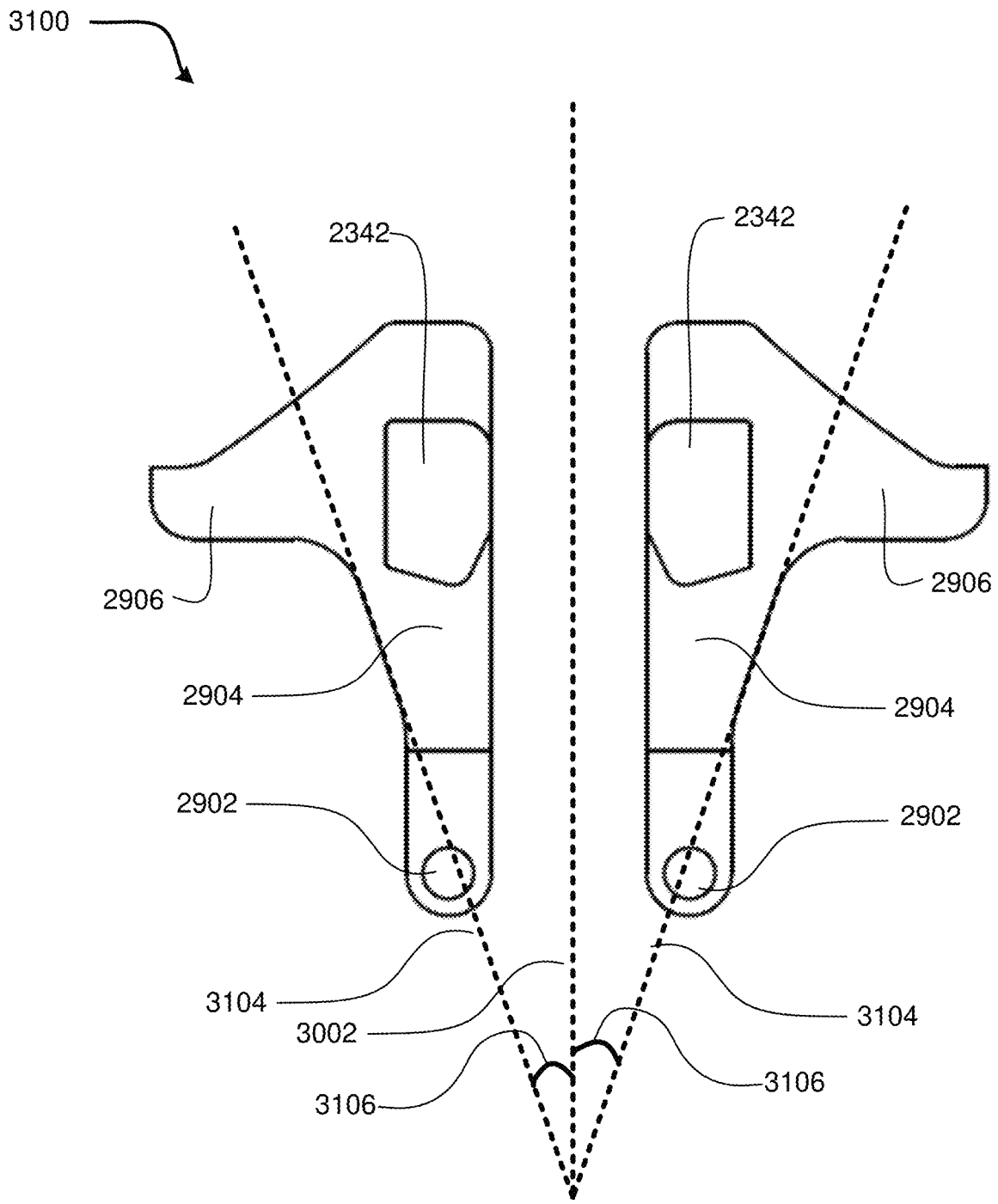
FIG. 31 is a straight-on side view of an extended orientation of a pair of latch ears of a spring loaded latch assembly.

FIG. 31 is a straight-on side view of an extended orientation 3100 for a pair of latch ears 2214 of the spring loaded latch assembly 2202. The latch arm 2904 of the latch ear 2214 may angle outward to form a latch angle 3106. The extended angle 3106 permits the latch ear 2214 to remain in the extended (latched) orientation (as shown in FIG. 31) by causing the latch ear 2214 to engage with the latch holding slot 2338 of the retractor case 302.

The latch angle 3106 is defined by an angle formed in between the vertical axis 3002 and a latch axis 3104. The vertical axis 3002 is parallel to a longitudinal axis of the head assembly 2200. The latch axis 3104 runs along an exterior side of the latch arm 2904 as shown in FIG. 31. The latch angle 3106 may comprise from about from about 10 degrees to about 30 degrees; from about 12 degrees to about 28 degrees; from about 12 degrees to about 26 degrees; from about 15 degrees to about 24 degrees; from about 15 degrees to about 20 degrees; from about 16 degrees to about 19 degrees; or from about 17 degrees to about 18 degrees.

It will be appreciated by those skilled in the art that, while several implementations are described and shown in the exemplary figures herein, one implementation may have any number of features shown. The figures shown herein are intended to be exemplary and non-limiting, and some figures show some features that other figures do not simply for clarity and readability. In other words, it is contemplated that one implementation of the disclosure may feature each and every feature disclosed, or an implementation may feature a subset combination of the features shown without departing from the scope of the disclosure.

In various implementations, a stand for holding or otherwise housing reservoirs and tubes, hoses or lines may be located outside of the edifice. The stand may be a metal stand or made from another material and may be configured to fit inside the edifice for transport to a location.

The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

In the foregoing Detailed Description, various features of the disclosure are grouped together in a single implementation for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the following and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

Reference throughout this specification to "an example" means that a particular feature, structure, or characteristic described in connection with the example is included in at least one implementation or embodiment of the disclosure. Thus, appearances of the phrase "in an example" in various places throughout this specification are not necessarily all referring to the same implementation or embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various implementations, embodiments, and examples of the disclosure may be referred to herein along with alternatives for the various components thereof. It is understood that such implementations, embodiments, examples, and alternatives are not to be construed as de facto equivalents of one another but are to be considered as separate and autonomous representations of the disclosure.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the implementations or embodiments are to be considered illustrative and not restrictive.

Those having skill in the art will appreciate that many changes may be made to the details of the above-described implementations or embodiments without departing from the underlying principles of the disclosure. The scope of the disclosure should, therefore, be determined only by the following claims.

EXAMPLES

The following examples pertain to further implementations or embodiments.

Example 1 is an assembly. The drill assembly includes An assembly for performing a drilling operation in a substrate, the drill assembly comprising: a retractor case comprising a retractor sidewall and a retractor pin slot disposed within the retractor sidewall, wherein the retractor sidewall defines a retractor interior space; a body comprising a body sidewall and a body pin slot disposed within the body sidewall, wherein the body sidewall defines a body interior space, and wherein the body interior space is configured to receive the retractor case; a latch ear coupled to the body, wherein at least a portion of the latch ear extends outward relative to the body sidewall; and an expansion block at least partially disposed within the retractor interior space; wherein a position of the expansion block along a longitudinal axis of the drill assembly determines whether the latch ear is in an extended position or a retracted position relative to the body sidewall.

Example 2 is an assembly as in Example 1, wherein the assembly comprises an uphole end and a downhole end that is located opposite to the uphole end; wherein the downhole end is located deeper in the substrate when at least a portion of the drill assembly is disposed within the substrate to perform the drilling operation.

Example 3 is an assembly as in any of Examples 1-2, wherein the expansion block comprises a pin hole disposed therethrough; wherein the body pin slot comprises a body pin slot length extending along the longitudinal axis of the drill assembly; and wherein the body pin slot comprises a body pin slot uphole end corresponding with the uphole end of the drill assembly; and wherein the body pin slot comprises a body pin slot downhole end located at an opposite end of the body pin slot length relative to the body pin slot uphole end.

Example 4 is an assembly as in any of Examples 1-3, further comprising a pin, wherein the pin is configured to be disposed through each of the body pin slot, the retractor pin slot, and the pin hole.

Example 5 is an assembly as in any of Examples 1-4, wherein the expansion block is located at a maximum uphole expansion position when the pin abuts one or more of the retractor pin slot uphole end or the body pin slot uphole end.

Example 6 is an assembly as in any of Examples 1-5, wherein the latch ear is in the retracted position relative to the body sidewall when the expansion block is located at the maximum uphole expansion position along the longitudinal axis of the drill assembly.

Example 7 is an assembly as in any of Examples 1-6, wherein the expansion block is located at a maximum downhole expansion position when the pin abuts one or more of the retractor pin slot downhole end or the body pin slot downhole end.

Example 8 is an assembly as in any of Examples 1-7, wherein the latch ear is in the extended position relative to the body sidewall when the expansion block is located at the maximum downhole expansion position along the longitudinal axis of the drill assembly.

Example 9 is an assembly as in any of Examples 1-8, wherein the latch ear comprises: a latch ear body; a latch pivot hole disposed through the latch ear body; a latch ear radial extension, wherein the latch ear radial extension extends substantially radially outward relative to the body sidewall; and a latch ear expansion interface leg.

Example 10 is an assembly as in any of Examples 1-9, wherein the latch ear radial extension is located at a latch downhole end of the latch ear, wherein the latch downhole end corresponds with the downhole end of the drill assembly; and wherein the latch ear expansion interface leg is located at a latch uphole end of the latch ear, wherein the latch uphole end is located opposite to the latch downhole end.

Example 11 is an assembly as in any of Examples 1-10, wherein the retractor case is configured to engage with a tube to lift the drill assembly upward out of a hole formed in the substrate; and wherein the latch ear radial extension interfaces with an interior surface of the tube when the drill assembly is installed within the tube.

Example 12 is an assembly as in any of Examples 1-11, wherein the body further comprises: a latch channel disposed within the body sidewall, wherein the latch channel is configured to receive the latch ear body; and a body pivot hole disposed within the body sidewall; wherein the latch pivot hole aligns with the body pivot hole when the latch ear body is disposed within the latch channel; and wherein a latch axis of rotation is formed at the aligned body pivot hole and latch pivot hole such that the latch ear rotates about the latch axis of rotation when the latch ear body is disposed within the latch channel.

Example 13 is an assembly as in any of Examples 1-12, wherein the expansion block comprises an expansion body that comprises a polygonal geometry; wherein the polygonal geometry comprises at least one exterior interface angle that is less than 45 degrees; and wherein the exterior interface angle is configured to interface with the latch ear expansion interface leg.

Example 14 is an assembly as in any of Examples 1-13, wherein latch ear comprises an interface angle defined by a first angle arm extending along a surface of the latch ear body, and a second angle arm extending along a surface of the latch ear expansion interface leg; and wherein the interface angle is greater than 90 degrees.

Example 15 is an assembly as in any of Examples 1-14, wherein a sum of the exterior interface angle of the expansion block and the interface angle of the latch ear is equal to about 180 degrees.

Example 16 is an assembly as in any of Examples 1-15, further comprising a fluid retention piston coupled to the expansion block.

Example 17 is an assembly as in any of Examples 1-16, wherein the assembly comprises two latch ears; wherein each of the two latch ears is coupled to the body and extends outward relative to the body sidewall; and wherein the two latch ears are positioned on the body sidewall that the two latch ears are diametrically opposed to one another.

Example 18 is an assembly as in any of Examples 1-17, wherein the expansion block comprises a surface that is substantially aligned with a longitudinal axis of the drill assembly.

Example 19 is an assembly as in any of Examples 1-18, wherein the latch ear comprises a latching surface; wherein, in response to the latch ear being disposed in the extended position, the latching surface of the latch ear forms an interference fit with an interior surface of a tube when the drill assembly is disposed within the tube for performing the drilling operation; and wherein, in response to the latch ear being disposed in the retracted position, the latching surface of the latch ear is radially narrow sufficient to avoid contacting the interior surface of the tube when the drill assembly is disposed within the tube.

Example 20 is an assembly as in any of Examples 1-19, wherein the latch ear is rotatably coupled to the body at a pivot point, and wherein the pivot point is located at substantially a center of a length of the latch ear.

Example 21 is an assembly as in any of Examples 1-20, wherein the drill assembly includes a body comprising a sidewall, wherein the sidewall defines a hollow interior comprising a fluid chamber, and wherein the hollow interior is aligned with a longitudinal axis of the drill assembly. The drill assembly includes a fluid retention piston disposed within the fluid chamber, wherein the fluid retention piston comprises a fluid port enabling a fluid to pass through the fluid retention piston. The drill assembly includes a valve assembly disposed within the fluid retention piston, wherein the valve assembly comprises: a valve bushing comprising a sidewall that defines a bushing interior space; a valve ball; and a valve spring. The drill assembly is such that the valve assembly is in a closed configuration when the valve ball is at least partially disposed within the bushing interior space and prevents fluid from flowing through the bushing interior space.

Example 22 is an assembly as in any of Examples 1-21, wherein the assembly comprises an uphole end and a downhole end that is located opposite to the uphole end; wherein the downhole end is located deeper in the substrate when at least a portion of the drill assembly is disposed within the substrate to perform the drilling operation; and wherein the spring is located nearer the downhole end relative to the ball.

Example 23 is an assembly as in any of Examples 1-22, wherein the valve assembly is in an open configuration when the fluid is permitted to flow through the bushing interior space.

Example 24 is an assembly as in any of Examples 1-23, wherein the valve spring is located nearer the downhole end relative to the valve bushing and the valve ball.

Example 25 is an assembly as in any of Examples 1-24, wherein the valve ball is located nearer the downhole end relative to the valve bushing when the valve assembly is in the open configuration.

Example 26 is an assembly as in any of Examples 1-25, wherein the valve ball is disposed within the bushing interior space when the valve assembly is in the closed configuration.

Example 27 is an assembly as in any of Examples 1-26, wherein the valve bushing comprises an interior bushing diameter defined as a diameter of the bushing interior space; wherein the valve ball comprises a ball diameter; and wherein the interior bushing diameter is substantially equivalent to the ball diameter such that the fluid is prevented from flowing through the bushing interior space when the valve ball is disposed within the valve bushing.

Example 28 is an assembly as in any of Examples 1-27, wherein a maximum volumetric flow rate through the fluid chamber is adjusted by opening or closing the valve assembly. \

Example 29 is an assembly as in any of Examples 1-28, wherein the valve assembly transitions from the closed configuration into an open configuration in response to the valve ball experiencing an external force that exceeds a valve threshold force; and wherein the external force moves from the uphole end of the drill assembly toward the downhole end of the drill assembly.

Example 30 is an assembly as in any of Examples 1-29, wherein the valve assembly transitions from the closed configuration into the open configuration in response to the valve ball moving from being at least partially disposed within the bushing interior space, to being located nearer the downhole end of the drill assembly relative to the valve bushing; and wherein the valve ball is disposed in between the valve spring and the valve bushing when the valve assembly is in the open configuration.

Example 31 is an assembly as in any of Examples 1-30, wherein the valve ball comprises a ball diameter; and wherein the valve threshold force is substantially equivalent to a magnitude of force required to compress the valve spring a compression distance that is substantially equal to the ball diameter.

Example 32 is an assembly as in any of Examples 1-31, wherein a restoring force applied by the valve spring on the valve ball urges the valve ball toward the uphole end of the drill assembly; and wherein the valve assembly transitions from the open configuration to the closed configuration in response to the restoring force applied by the valve spring on the valve ball exceeding the external force applied on the valve ball.

Example 33 is an assembly as in any of Examples 1-32, wherein the external force comprises pressurized fluid pumped into the drill assembly from the uphole end toward the downhole end.

Example 34 is an assembly as in any of Examples 1-33, wherein the fluid flows through the fluid chamber with laminar flow.

Example 35 is an assembly as in any of Examples 1-34, wherein the body comprises: an upper body comprising an upper sidewall defining a substantially cylindrical geometry, wherein the upper sidewall defines an upper hollow interior; one or more upper body ports disposed within the upper sidewall, wherein the one or more upper body ports permit the fluid to pass into and out of the upper hollow interior; a lower body comprising a lower sidewall defining a substantially cylindrical geometry, wherein the lower sidewall defines a lower hollow interior; and one or more lower body ports disposed within the lower sidewall, wherein the one or more lower body ports permit the fluid to pass into and out of the lower hollow interior.

Example 36 is an assembly as in any of Examples 1-35, wherein at least a portion of the upper sidewall is overlapped with at least a portion of the lower sidewall to form the fluid chamber of the body; and wherein the fluid passes into and out of the fluid chamber through one or more of: the one or more upper body ports; or the one or more lower body ports.

Example 37 is an assembly as in any of Examples 1-36, wherein at least a portion of the upper sidewall is overlapped with at least a portion of the lower sidewall to form the fluid chamber of the body; and wherein the fluid enters and exits the drill assembly through the fluid port of the fluid retention piston, and further through one or more of the one or more upper body ports or the one or more lower body ports.

Example 38 is an assembly as in any of Examples 1-37, further comprising: a fluid retention shaft; and a fluid retention cage attached to the fluid retention shaft, wherein the fluid retention cage comprises a plurality of fluid cage ports enabling the fluid to pass into and out of the fluid retention cage; wherein the fluid retention cage is located nearer the downhole end of the drill assembly relative to the fluid retention shaft.

Example 39 is an assembly as in any of Examples 1-38, wherein the fluid retention piston comprises a cylindrical piston body comprising a piston diameter; wherein the piston diameter of the cylindrical piston body is greater than a cage diameter of the fluid retention cage; wherein the cylindrical piston body is configured to receive the fluid retention cage.

Example 40 is an assembly as in any of Examples 1-39, wherein a position of the valve ball along a longitudinal axis of the drill assembly indicates whether the valve assembly is in the closed configuration or is in an open configuration; wherein the valve assembly is in the closed configuration when the valve ball forms a fluid-tight fit against an interior wall of the valve bushing, such that the fluid is prevented from passing through the bushing interior space; and wherein the valve assembly is in the open configuration when the valve ball is located in between the valve spring and the valve bushing, such that the fluid is permitted to flow through the bushing interior space, around the valve ball, and through the fluid port.

Example 41 is an assembly as in any of Examples 1-40, wherein a restoring force applied by the valve spring on the valve ball causes the valve assembly to transition from an open configuration to the closed configuration.

Example 42 is an assembly as in any of Examples 1-41, wherein the drill assembly includes a tube cap piston comprising a threaded recess. The drill assembly includes a viscosity adjustment screw coupled to the tube cap piston, wherein a threaded portion of the viscosity adjustment screw is screwed into the threaded recess of the tube cap piston. The drill assembly includes a tube cap comprising a tube cap sidewall, wherein the tube cap further comprises a tube cap port disposed within the tube cap sidewall. The drill assembly is such that the tube cap piston and the viscosity adjustment screw are disposed within a hollow interior space defined by the tube cap sidewall. The drill assembly is such that a fluid passageway is formed in between the tube cap port and an exterior surface of the tube cap piston. The drill assembly is such that the threaded portion of the viscosity adjustment screw is threaded into or out of the threaded recess of the tube cap piston to adjust a size of the fluid passageway.

Example 43 is an assembly as in any of Examples 1-42, further comprising a terminating tube cap located at a downhole end of the drill assembly; wherein the downhole end of the drill assembly is located deeper in the substrate when at least a portion of the drill assembly is disposed within the substrate to perform the drilling operation; and wherein a uphole end of the drill assembly is located opposite to the downhole end of the drill assembly.

Example 44 is an assembly as in any of Examples 1-43, wherein the tube cap further comprises a viscosity wall disposed within the hollow interior space defined by the tube cap sidewall; wherein the viscosity adjustment screw comprises the threaded portion and further comprises a head portion; and wherein the head portion interfaces with the viscosity adjustment wall.

Example 45 is an assembly as in any of Examples 1-44, wherein the tube cap piston comprises larger diameter body located nearer the uphole end of the drill assembly; and wherein the tube cap piston comprises a smaller diameter body located neared the downhole end of the drill assembly.

Example 46 is an assembly as in any of Examples 1-45, wherein the tube cap piston further comprises: a larger diameter face located at the uphole end of the tube cap piston; and a smaller diameter face located at the downhole end of the tube cap piston.

Example 47 is an assembly as in any of Examples 1-46, wherein a diameter of the larger diameter body is greater than a diameter of the larger diameter face; and wherein the tube cap piston comprises a chamfered edge extending from an edge of the larger diameter body to an edge of the larger diameter face.

Example 48 is an assembly as in any of Examples 1-47, wherein a diameter of the smaller diameter body is greater than a diameter of the smaller diameter face; and wherein the tube cap piston comprises a chamfered edge extending from an edge of the smaller diameter body to an edge of the smaller diameter face.

Example 49 is an assembly as in any of Examples 1-48, wherein the tube cap piston comprises a piston chamfered edge configured to form an interference fit with a corresponding chamfered edge of the tube cap.

Example 50 is an assembly as in any of Examples 1-49, wherein partially unscrewing the threaded portion from the threaded recess of the tube cap piston increases the size of the fluid passageway; and wherein increasing the size of the fluid passageway enables higher viscosity fluids to flow through the fluid passageway.

Example 51 is an assembly as in any of Examples 1-50, wherein unscrewing the threaded portion further into the threaded recess of the tube cap piston decreases the size of the fluid passageway; and wherein decreasing the size of the fluid passageway prevents higher viscosity fluids from flowing through the fluid passageway.

Example 52 is an assembly as in any of Examples 1-51, wherein the fluid passageway permits fluids comprising a flow rate from about one quart per 28 seconds, to about one quart per 100 seconds, to pass through the fluid passageway when the threaded portion of the viscosity adjustment screw is fully threaded into the threaded recess of the tube cap piston.

Example 53 is an assembly as in any of Examples 1-52, wherein a maximum fluid viscosity permitted to pass through the fluid passageway is a flow rate of up to about one quart per 65 seconds.

Example 54 is an assembly as in any of Examples 1-53, further comprising a spindle; wherein the spindle comprises a shock absorption spring; and wherein the shock absorption spring is disposed within the hollow interior space defined by the tube cap sidewall.

Example 55 is an assembly as in any of Examples 1-54, wherein the shock absorption spring prevents or mitigates damage to the drill assembly when one or more of: the drill assembly is lowered into the substrate and contacts a core barrel; or an overshot is lowered into the substrate and contacts a retractor case of the drill assembly.

Example 56 is an assembly as in any of Examples 1-55, wherein the tube cap piston is exchangeable, and wherein the size of the fluid passageway is further adjustable based on a size of the tube cap piston.

What is claimed is:

1. An assembly for performing a drilling operation in a substrate, the assembly comprising:

a retractor case comprising a retractor sidewall and a retractor pin slot disposed within the retractor sidewall, wherein the retractor sidewall defines a retractor interior space;

a body comprising a body sidewall and a body pin slot disposed within the body sidewall, wherein the body sidewall defines a body interior space, and wherein the body interior space is configured to receive the retractor case;

a first latch ear coupled to the retractor case;

a second latch ear coupled to the retractor case; and a compression spring disposed in between the first latch ear and the second latch ear;

wherein a mechanical equilibrium for the compression spring causes at least a portion of the first latch ear and at least a portion of the second latch ear to extend outward relative to the body sidewall.

2. The drill assembly of claim 1, wherein the first latch ear comprises a first latch arm comprising an interior side and an exterior side, wherein the interior side is located nearer the body interior space than the exterior side;

wherein the second latch ear comprises a second latch arm comprising an interior side and an exterior side, wherein the interior side is located nearer the body interior space than the exterior side; and wherein the mechanical equilibrium for the compression spring causes the interior side of the first latch arm to be oriented parallel to a longitudinal axis of the drill assembly within a tolerance of ten percent; and wherein the mechanical equilibrium for the compression spring causes the interior side of the second latch arm to be oriented parallel to the longitudinal axis of the drill assembly within a tolerance of ten percent.

3. The drill assembly of claim 1, further comprising:

a first latch ear pivot point, wherein the first latch ear pivot point couples the first latch ear to the retractor case such that the first latch ear is rotatable about the first latch ear pivot point; and a second latch ear pivot point, wherein the second latch ear pivot point couples the second latch ear to the retractor case such that the second latch ear is rotatable about the second latch ear pivot point.

4. The drill assembly of claim 1, wherein the assembly comprises an uphole end and a downhole end that is located opposite to the uphole end;

wherein the downhole end is located deeper in the substrate when at least a portion of the drill assembly is disposed within the substrate to perform the drilling operation; and wherein the latch ear is located nearer to the uphole end than the downhole end.

5. The drill assembly of claim 1, wherein each of the first latch ear and the second latch ear comprises:

a latch arm;

a latch pivot head attached to the latch arm;

a latch pivot hole disposed through the latch pivot head; and a latch ear radial extension attached to the latch arm, wherein the latch ear radial extension extends substantially radially outward relative to the latch arm.

6. The drill assembly of claim 5, wherein a latch angle formed in between an interior side of the latch arm and an exterior side of the latch is from about 10 degrees to about 30 degrees.

7. The drill assembly of claim 5, wherein the latch ear radial extension is located at a latch uphole end of the latch ear, wherein the latch uphole end corresponds with a uphole end of the drill assembly.

8. The drill assembly of claim 5, wherein the retractor case is configured to engage with a tube to lift the drill assembly upward out of a hole formed in the substrate; and wherein the latch ear radial extension interfaces with an interior surface of the tube when the drill assembly is installed within the tube.

9. The drill assembly of claim 5, wherein the retractor case further comprises:

a first latch holding slot disposed within the retractor sidewall, wherein the first latch holding slot is configured to receive a portion of the first latch ear;

a second latch holding slot disposed within the retractor sidewall, wherein the second latch holding slot is configured to receive a portion of the second latch ear; and a first retractor pivot hole pair each disposed within the retractor sidewall;

a second retractor pivot hole pair each disposed within the retractor sidewall;

wherein a first latch pivot hole of the first latch ear aligns with the first retractor pivot hole pair;

wherein a second latch pivot hole of the second latch ear aligns with the second retractor pivot hole pair;

wherein a first latch axis of rotation is formed at the aligned first latch pivot hole and first retractor pivot hole pair such that the first latch ear rotates about the first latch axis of rotation; and wherein a second latch axis of rotation is formed at the aligned second latch pivot hole and second retractor pivot hole pair such that the second latch ear rotates about the second latch axis of rotation.

10. The drill assembly of claim 1, wherein a compressive force of the compression spring is optimized such that the compression spring permits each of the first latch ear and the second latch ear to retract inward toward the body interior space when each of the first latch ear and the second latch ear press against an interior surface of a tube when the drill assembly is disposed within the tube for performing the drilling operation.

11. The drill assembly of claim 1, wherein the retractor case further comprises a latch holding slot disposed within the retractor sidewall;

wherein the latch holding slot comprises a bent geometry comprising a first angle;

wherein a latch arm of one or more of the first latch ear or the second latch ear also comprises the first angle within a 10-percent tolerance threshold.

12. The drill assembly of claim 11, wherein the first angle of the latch arm of one or more of the first latch ear of the second latch ear is configured to interface with the first angle of the latch holding slot.

13. The drill assembly of claim 1, further comprising a spring detent configured to maintain the latch ear in a retracted position, wherein the spring detent comprises:

a ball; and a compression spring spanning across the body interior space.

14. The drill assembly of claim 1, wherein the body interior space comprises a fluid chamber, and wherein the assembly further comprises:

a fluid retention piston disposed within the fluid chamber, wherein the fluid retention piston comprises a fluid port enabling a fluid to pass through the fluid retention piston; and a valve assembly disposed within the fluid retention piston.

15. The drill assembly of claim 14, wherein the valve assembly comprises:

a valve bushing comprising a sidewall that defines a bushing interior space;

a valve ball; and a valve spring;

wherein the valve assembly is in a closed configuration when the valve ball is at least partially disposed within the bushing interior space and prevent fluid from flowing through the bushing interior space.

16. The drill assembly of claim 14, wherein the fluid retention piston comprises a slotted spring pin.

17. The drill assembly of claim 14, wherein the latch ear comprises two latch ears that are located on opposite sides of the body sidewall such that the two latch ears are diametrically opposed to one another; and wherein the fluid retention piston is disposed in between the two latch ears.

18. The drill assembly of claim 17, wherein the fluid retention piston is disposed in between the two latch ears such that the fluid retention piston serves as a stopper to prevent the two latch ears from rotating in toward the body interior space past a maximum retraction rotation configuration.

19. The drill assembly of claim 1, wherein the assembly comprises two latch ears;

wherein each of the two latch ears is coupled to the body and extends outward relative to the body sidewall; and wherein the two latch ears are positioned on the body sidewall that the two latch ears are diametrically opposed to one another.

20. The drill assembly of claim 1, wherein the latch ear comprises a latching surface;

wherein, in response to the latch ear being disposed in the extended position, the latching surface of the latch ear forms an interference fit with an interior surface of a tube when the drill assembly is disposed within the tube for performing the drilling operation; and wherein, in response to the latch ear being disposed in the retracted position, the latching surface of the latch ear is radially narrow sufficient to avoid contacting the interior surface of the tube when the drill assembly is disposed within the tube.

* * * * *